US010793380B2

(12) United States Patent
Hirano

(10) Patent No.: US 10,793,380 B2
(45) Date of Patent: Oct. 6, 2020

(54) FEEDING APPARATUS

(71) Applicant: CANON KABUSHIKI KAISHA, Tokyo (JP)

(72) Inventor: Yuya Hirano, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/033,965

(22) Filed: Jul. 12, 2018

(65) Prior Publication Data

US 2019/0023513 A1 Jan. 24, 2019

(30) Foreign Application Priority Data

Jul. 20, 2017 (JP) ..... 2017-141120

(51) Int. Cl.

*B65H 3/06* (2006.01)
*G03G 15/00* (2006.01)
*B65H 3/52* (2006.01)

(52) U.S. Cl.

CPC ..... *B65H 3/06* (2013.01); *B65H 3/5215* (2013.01); *B65H 3/5261* (2013.01); *G03G 15/55* (2013.01); *G03G 15/6511* (2013.01); *B65H 2557/652* (2013.01); *B65H 2601/324* (2013.01)

(58) Field of Classification Search

CPC ..... B65H 3/5215; B65H 3/5261; B65H 2557/652

See application file for complete search history.

(56) References Cited

U.S. PATENT DOCUMENTS 7,588,245 B2 * 9/2009 Mandel ..... B65H 3/5261 271/122
10,364,109 B2 * 7/2019 Hirano ..... B65H 7/02
2003/0193126 A1 * 10/2003 Hoberock ..... B65H 3/0607 271/10.11

FOREIGN PATENT DOCUMENTS

JP 11-35183 A 2/1999
JP 11035183 A * 2/1999
JP 2000095371 A 4/2000
JP 2003341866 A 12/2003
JP 2011184129 A 9/2011

* cited by examiner

*Primary Examiner* — Jeremy R Severson
(74) *Attorney, Agent, or Firm* — Canon U.S.A., Inc. I.P. Division

(57) ABSTRACT

A feeding apparatus includes a rotary member unit having a feeding rotary member to feed a recording material and a separating rotary member which forms a nip portion with the feeding rotary member, an output unit, and a control unit. Where a single recording material is fed to the nip portion, the separating rotary member is rotated in a predetermined direction by the single recording material and, where recording materials are overlapped with one another and fed to the nip portion, the separating rotary member rotation is stopped or rotated in a direction opposite to the predetermined direction to separate the overlapped recording materials. The output unit outputs a state signal in accordance with a separating rotary member rotation state. The control unit obtains a rotation speed of the separating rotary member from the state signal output and determines that the rotary member unit is replaced with a new product.

12 Claims, 17 Drawing Sheets

FEEDING APPARATUS

BACKGROUND OF THE INVENTION

Field of the Invention

The present disclosure relates to a feeding apparatus that performs feeding control of a recording material for a copier, a printer, or the like.

Description of the Related Art

Up to now, an image forming apparatus such as a copier or a printer is provided with a mechanism for separating sheets loaded in a cassette one by one to be fed. Japanese Patent Laid-Open No. 2000-95371 describes a retard separation method using a roller unit constituted by a feed roller and a separation roller. According to Japanese Patent Laid Open No. 2000-95371, the number of sheets that have been fed is counted, and in a case where the count value becomes a predetermined value, it is determined that the roller unit has reached its end of life (operating lifetime).

When it is determined that the roller unit has reached its end of life, to avoid future conveyance malfunction such as a print failure, the image forming apparatus urges a user, a service man, or the like to replace the roller After the roller unit is replaced with a new (unused) product, the user, the service man, or the like operates the image forming apparatus to reset its end-of-life status, so that the image forming apparatus can recognize that the roller unit has been replaced with the new product. However, in a case where the user, the service man, or the like forgets an operation for resetting the end-of-life status after the roller unit is replaced with the new product, the image forming apparatus does not recognize that the roller unit has been replaced with the new product. As a result, for example, the count number of the number of fed sheets is not reset, and the determination on the end-of-life status of the roller unit is not performed.

SUMMARY OF THE INVENTION

In an example, a feeding apparatus automatically determines that a rotary member unit constituted by a feeding rotary member and a separating rotary member is replaced with a new product.

According to an aspect of the present invention, a feeding apparatus includes a rotary member unit including a feeding rotary member configured to feed a recording material and a separating rotary member which forms a nip portion with the feeding rotary member, wherein, in a case where a single recording material is fed to the nip portion, the separating rotary member is configured to be rotated in a predetermined direction by the single recording material and, in a case where a plurality of recording materials are overlapped with one another and fed to the nip portion, the rotation of separating rotary member is configured to be stopped or rotated in a direction opposite to the predetermined direction to separate the overlapped plurality of recording materials from one another at the nip portion, an output unit configured to output a state signal in accordance with a rotation state of the separating rotary member, and a control unit configured to obtain a rotation speed of the separating rotary member from the state signal output from the output unit and, based on the obtained rotation speed of the separating rotary member, to determine that the rotary member unit is replaced with a new product.

DESCRIPTION OF THE EMBODIMENTS

First Embodiment

Descriptions on a Configuration of an Image Forming Apparatus

Figure 1:
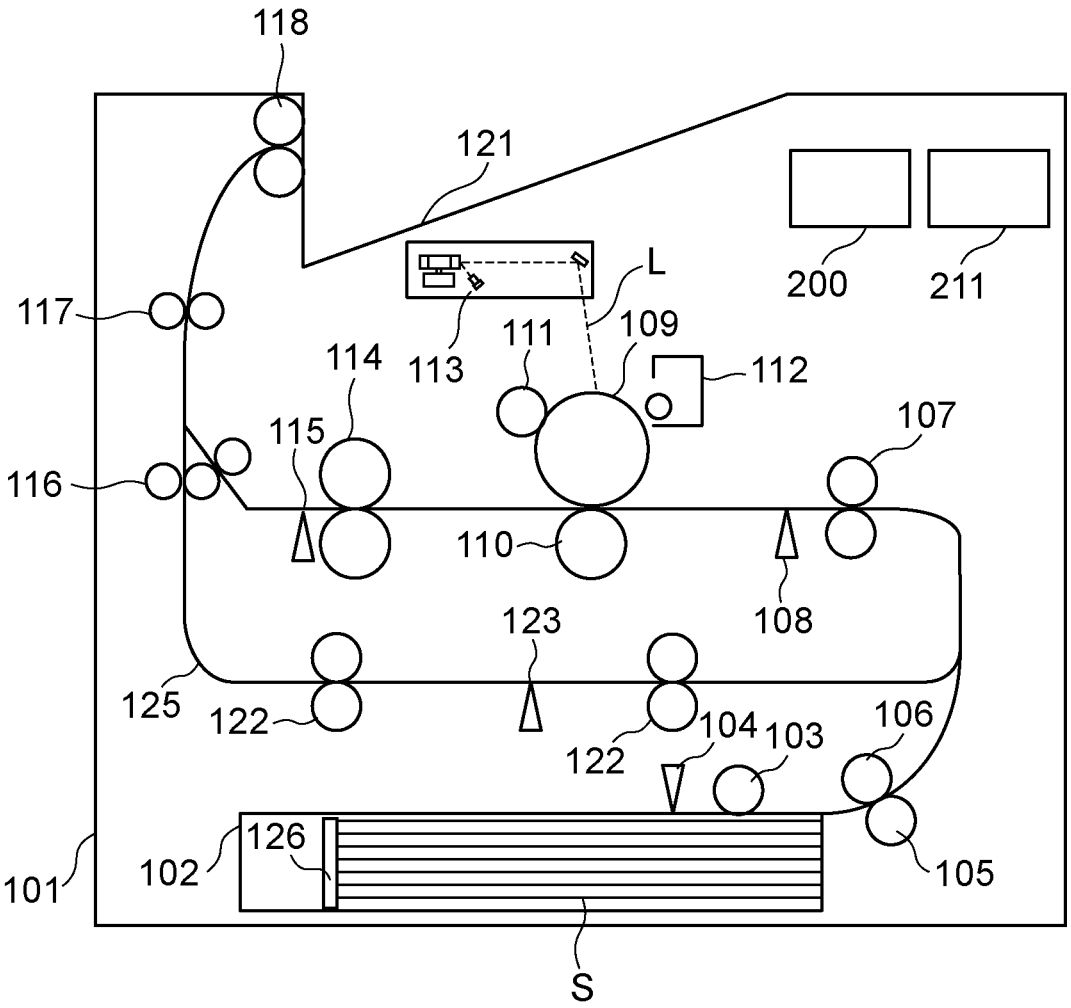
FIG. 1 illustrates a configuration of an image forming apparatus.

According to a first embodiment, a laser beam printer 101 of an electrophotographic method (hereinafter, referred to as a printer 101) is illustrated as an image forming apparatus. FIG. 1 is a schematic configuration diagram of the printer 101. A cassette 102 is a tray in which sheets S corresponding to recording materials are loaded (accommodated) and is detachably attachable to a main body of the printer 101. A rear end regulating plate 126 included in the cassette 102 regulates a rear end of the sheet S loaded in the cassette 102. Herein, the rear end of the sheet S refers to an end on an upstream side in a feeding direction of the sheet S. The rear end regulating plate 126 is movable in the feeding direction and is located at a regular position in accordance with a size of the sheet S (length in the feeding direction), so that the sheet S is set at an appropriate position.

In a state in which the cassette 102 is attached to the main body of the printer 101, a pickup roller 103 corresponding to a pickup rotating body (hereinafter, referred to as a pick roller 103) feeds (conveys) the sheet S loaded in the cassette 102. The sheet S fed by the pick roller 103 is further fed by a feed roller 106 corresponding to a feeding rotary member onto a downstream side in the conveyance direction of the sheet S. Then, the sheet S reaches a top sensor 108 via a registration roller pair 107. A separation roller 105 corresponding to a separating rotary member forms a separation nip portion with the feed roller 106 and avoids feeding of a plurality of sheets S (two sheets or more) onto the downstream side from the separation nip portion together. The operation of the separation roller 105 will be described below in detail. With this configuration, among the sheets S loaded in the cassette 102, only the sheet S located on the topmost position in a direction orthogonal to a bottom surface of the cassette 102 (vertical direction) is fed to the registration roller pair 107.

The sheet S detected by the top sensor 108 is conveyed to an image forming unit next. The image forming unit is provided with a photosensitive drum 109, a charging roller 111, a laser scanner 113, a development apparatus 112, a transfer roller 110, and a fixing apparatus 114. The photosensitive drum 109 is uniformly charged by the charging roller 111 and then irradiated with laser light L by the laser scanner 113, so that an electrostatic latent image is formed on a surface of the photosensitive drum 109. The thus formed electrostatic latent image is supplied with toner from the development apparatus 112 and visualized as a toner image. The photosensitive drum 109 and the transfer roller 110 form a transfer nip portion, and the sheet S is transferred to the transfer nip portion in synchronous with the rotation of the photosensitive drum 109. The toner image formed on the photosensitive drum 109 is transfer onto the sheet S at the transfer nip portion. To transfer the toner image, the transfer roller 110 is applied with a voltage having a polarity opposite to that of the toner image. The sheet S to which the toner image is transferred is conveyed to the fixing apparatus 114 to be heated and pressurized there. As a result, the unfixed toner image transferred to the sheet S is fixed onto the sheet S. The sheet S on which the toner image is fixed is conveyed by a triple roller 116, an intermediate discharge roller 117, and a discharge roller 118 and discharged onto a discharge tray 121. The series of printing operation is ended as described above.

In a case where printing is performed on both sides of the sheet S, the sheet S on which the printing is ended on one side is not discharged onto the discharge tray 121, and the triple roller 116, the intermediate discharge roller 117, and the discharge roller 118 are caused to perform reverse rotation after the rear end of the sheet S passes through the triple roller 116. The sheet S is conveyed to a duplex conveyance path 125 and further conveyed to the image forming unit again by a duplex conveyance roller 122. With this configuration, printing can be performed on both sides of the sheet S.

In FIG. 1, a fixing discharge sensor 115 and a duplex conveyance sensor 123 are provided to determine whether or not the sheet S is normally conveyed. In addition, a sheet presence absence sensor 104 is provided to detect whether or not the sheet S is loaded in the cassette 102. An operation panel 211 (hereinafter, referred to as a panel 211) corresponding to a display unit is included in the printer 101 and displays various information to a user. The printer 101 is provided with an image forming apparatus control unit 200, and the image forming apparatus control unit 200 will be described in detail below.

Control Unit

Figure 2:
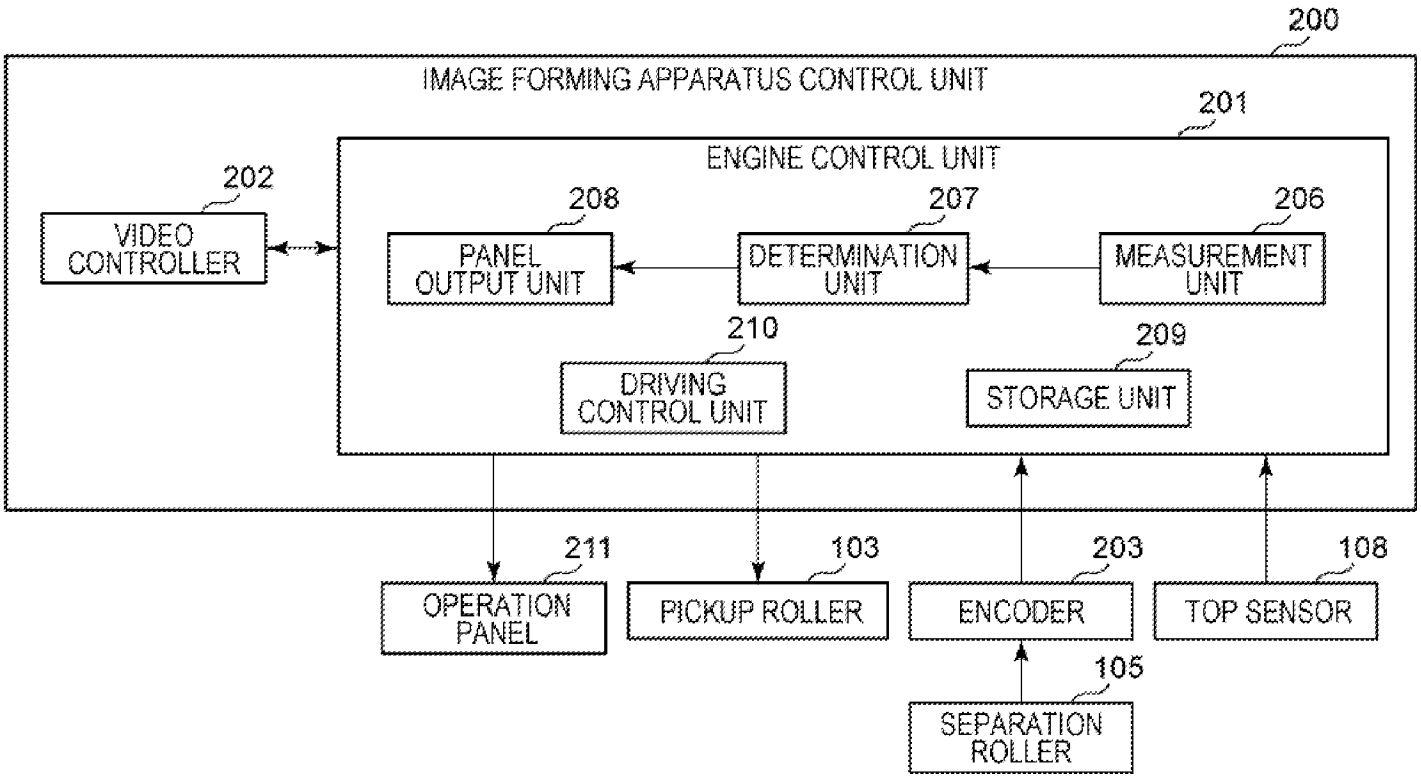
FIG. 2 is a control block diagram of the image forming apparatus.

FIG. 2 is a block diagram of the image forming apparatus control unit 200 of the printer 101. The image forming apparatus control unit 200 is constituted by an engine control unit 201 and a video controller 202. When the engine control unit 201 and the video controller 202 communicate with each other, the above-described printing operation is realized. For example, when a printing instruction is notified from an external device such as a personal computer (not illustrated), the video controller 202 analyzes image data, and the engine control unit 201 controls respective mechanisms of the printer 101. The engine control unit 201 includes the measurement unit 206, a determination unit 207, a panel output unit 208, a storage unit 209, and a driving control unit 210. The measurement unit 206 measures an elapsed time since the feeding of the sheet S is started by the pick roller 103. The measurement unit 206 also measures the rotation speed of the separation roller 105 based on a state signal in accordance with a rotation state of the separation roller 105 which is output from an encoder 203. The measurement unit 206 outputs the information of the measured time and the information of the measured rotation speed of the separation roller 105 to the determination unit 207.

The determination unit 207 executes the lifetime determination of the separation roller 105 based on the rotation speed of the separation roller 105 measured by the measurement unit 206. The determination unit 207 outputs the determined result to the panel output unit 208. The panel output unit 208 notifies the user of the information related to the lifetime of the separation roller 105 which is output from the determination unit 207 via the panel 211 or the external device. The storage unit 209 stores information of a printing request notified from the video controller 202, a time measured by the measurement unit 206 in the past, and the like. The driving control unit 210 controls activation and stopping of the sheet feeding mechanism in accordance with detection results of various sensors which will be described below.

The encoder 203 corresponding to an output unit and the top sensor 108 corresponding to a detection unit are connected to the engine control unit 201. The driving control unit 210 controls the driving of the pick roller 103 by using detection results of these sensors. Herein, a cord wheel arranged on the same axis of that of the separation roller 105 is used as the encoder 203, for example. In addition to the above, an optical rotary encoder, a magnetic rotary encoder, a photo interrupter, and the like can be used in accordance with a predetermined accuracy and a location to be arranged. Furthermore, the panel 211 for the panel output unit 208 to output the information is connected to the engine control unit 201.

Figure 3:
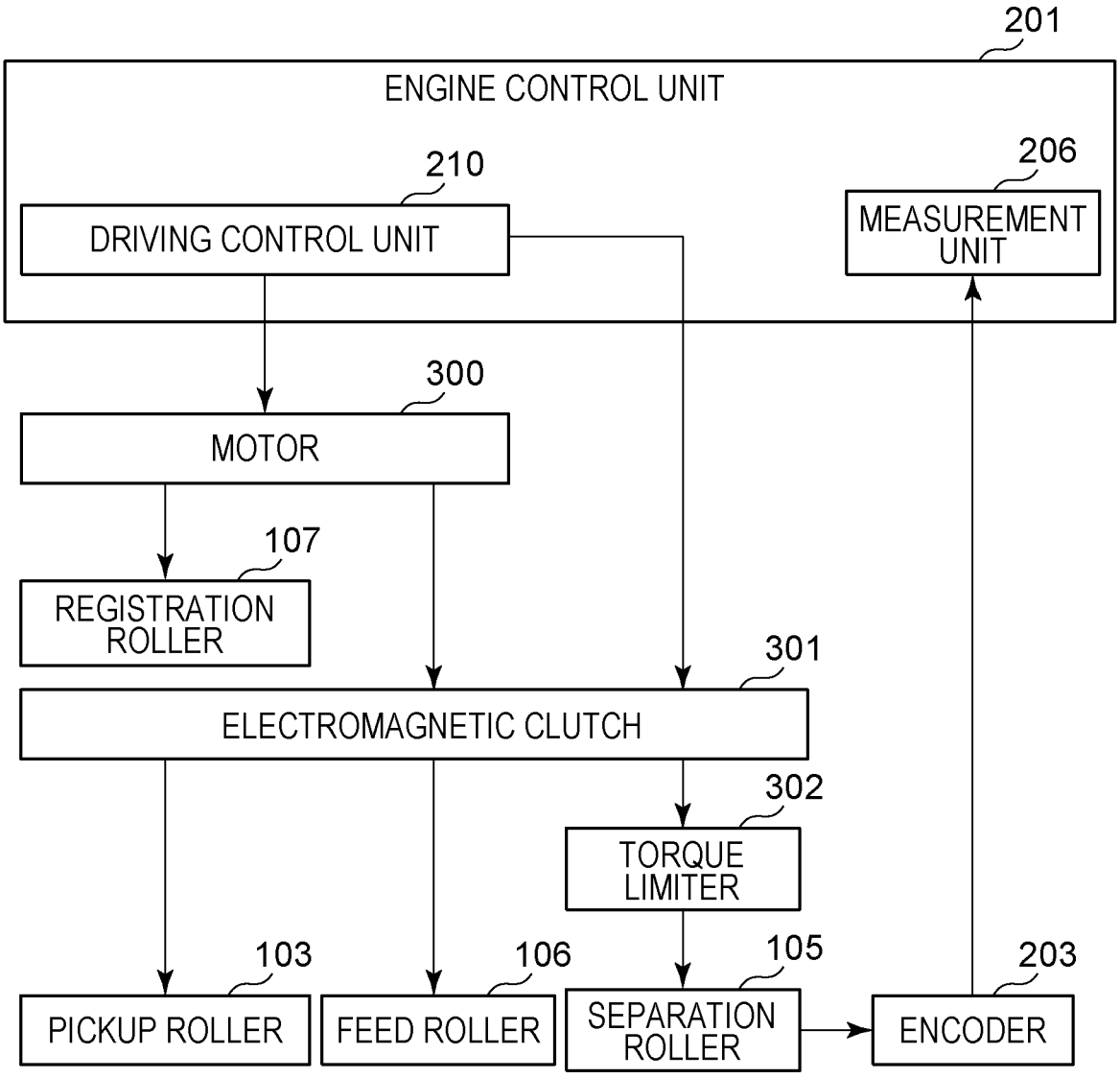
FIG. 3 is a control block diagram of a driving system.

FIG. 3 is a block diagram illustrating a detailed sheet feeding mechanism. In FIG. 3, a motor 300 is a driving source configured to drive the pick roller 103, the feed roller 106, the separation roller 105, and the registration roller pair 107. An electromagnetic clutch 301 transmits or interrupts the driving force of the motor 300 to the pick roller 103, the feed roller 106, and the separation roller. When the driving control unit 210 controls the motor 300 and the electromagnetic clutch 301, it is possible to switch on/off of the driving operations to the respective members. Although it will be described below, the driving is transmitted to the pick roller 103 and the feed roller 106 in the direction in which the sheet S is fed, and the driving is transmitted to the separation roller 105 in the direction in which the feeding of the sheet S is disturbed. Furthermore, a torque limiter 302 is provided between the electromagnetic clutch 301 and the separation roller 105. To detect the rotation state of the separation roller 105, the encoder 203 described above is installed in the printer 101, and information detected by the encoder 203 is input to the measurement unit 206. Herein, the information detected by the encoder 203 includes, for example, the rotation speed of the separation roller 105, that is, the number of rotations of the separation roller 105 per unit time. It should be noted that, according to the present embodiment, descriptions will be provided while the so-called retard roller where the driving is transmitted in the direction in which the feeding of the sheet S is disturbed is used as the separation roller 105, but a roller where the driving is not transmitted may also be adopted.

Descriptions on the Sheet Feeding Control

Next, sheet feeding control (feeding or conveyance control) of the printer 101 according to the first embodiment will be described with reference to FIGS. 4A to 4D and FIG. 5. FIGS. 4A to 4D illustrate cross sections of the sheet feeding mechanism at respective timings in a case here the sheet feeding operation (feeding or conveyance operation) from the cassette 102 is executed. A black arrow in FIGS. 4A to 4D indicates a state in which each roller rotates by receiving the driving force from the motor 300, and a white arrow indicates a state in which each roller is driven and rotated by the contacted sheet S or the opposite roller. It should be noted that, in FIGS. 4A to 4D, a shape of a conveyance path from the separation nip portion to the top sensor 108 is drawn to be different from that in FIG. 1. This is to facilitate the descriptions, and the same applies in drawings corresponding to FIGS. 4A to 4D according to the other embodiments. With regard to the graphic representation of FIG. 5, the horizontal axis indicates the elapsed time, and the vertical axis indicates a state of on or off (ON/OFF) of the driving of the pick roller 103 in (i), a signal waveform (on or off) of the top sensor 108 in (ii), and a rotation speed V of the separation roller 105 in (iii). Timings Ta to Td in the graphic representation of FIG. 5 respectively correspond to the state illustrated in FIGS. 4A to 4D.

Figure 4A:
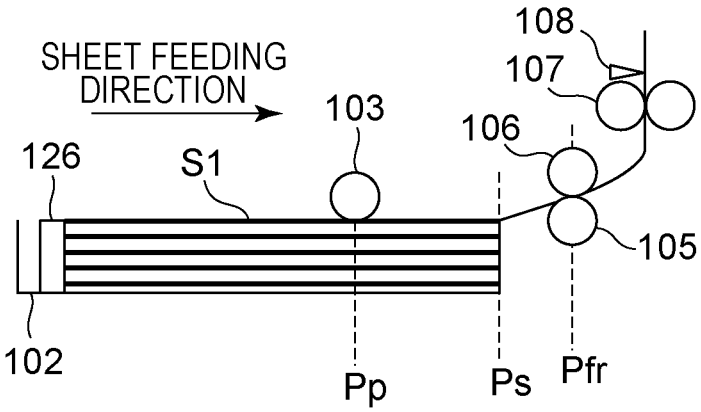
FIGS. 4A to 4D are explanatory diagrams for describing an operation of sheet feeding control according to a first embodiment.

FIG. 4A illustrates a cross section of the cassette 102 at a timing when the sheet S1 located on the topmost position which is loaded in the cassette 102 is fed. When the sheet feeding control is started, the pick roller 103, the feed roller 106, the separation roller 105 respectively rotate, and the sheet S1 is fed in the right direction in FIG. 4A (sheet feeding direction). The timing Ta in FIG. 5 corresponds to the state illustrated in FIG. 4A. At the timing Ta, the driving of the pick roller 103 is switched from off to on, and thereafter, the separation roller 105 starts the rotation. Herein, the start of the sheet feeding control indicates that the driving control unit 210 rotates the motor 300, and furthermore, the electromagnetic clutch 301 is turned on to transmit the driving force of the motor 300 to the pick roller 103, the feed roller 106, and the separation roller 105. The registration roller pair 107 rotates at a time when the driving control unit 210 rotates the motor 300.

It should be noted that a position Ps is a leading end position of the sheet S positioned by the rear end regulating plate 126 in FIG. 4A. Herein, the leading end of the sheet S refers to an end of the downstream side in the feeding direction of the sheet S. A position Pp is a position where the pick roller 103 abuts against the sheet S (where the sheet is nipped). A position Pfr indicates a position of the separation nip portion formed by the feed roller 106 and the separation roller 105.

Driving is transmitted to the separation roller 105 in the direction in which the feeding of the sheet S is disturbed (anticlockwise direction in FIGS. 4A to 4D), and also the torque limiter 302 (which is described with reference to FIG. 3) is provided. Herein, when the feed roller 106 starts the rotation in the direction in which the sheet S is fed (anticlockwise direction in FIGS. 4A to 4D), the separation roller 105 is operated as follows by the torque limiter 302. First, in a case where the sheet S does not exist at the separation nip portion, the force that the separation roller 105 receives from friction against the feed roller 106 is set to be higher than rotational load of the torque limiter 302. For this reason, the separation roller 105 is rotated by the feed roller 106 in the direction in which the sheet S is fed (clockwise direction in FIGS. 4A to 4D, a predetermined direction). In a case where the single sheet S is conveyed to the separation nip portion, the force that the separation roller 105 receives from the friction against the single sheet S is set to be higher than the rotational load of the torque limiter 302. For this reason, the separation roller 105 is rotated in the direction in which the sheet S is fed. On the other hand, the rotational load of the torque limiter 302 is set to be higher than the conveyance force by the sheets S in a case where two or more sheets S are overlapped with one another and conveyed to the separation nip portion. For this reason, the separation roller 105 stops since the conveyance force and the rotational load are comparable with each other, and furthermore, the rotational load of the torque limiter 302 becomes higher than the conveyance force to avoid the sheet feeding, that is, start the rotation in the direction opposite to the sheet feeding direction.

Figure 4B:
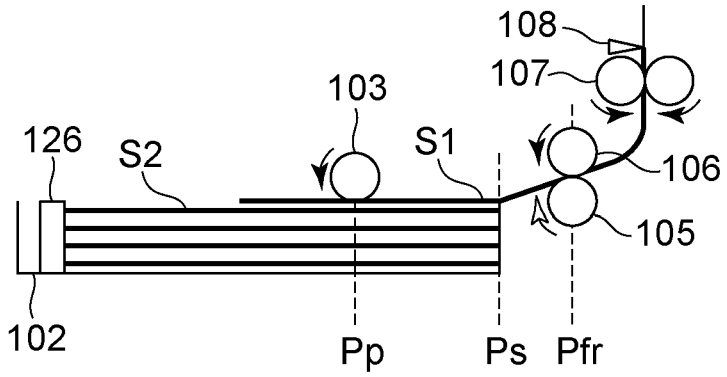

FIG. 4B illustrates a cross section of the cassette 102 at a timing when the leading end of the sheet S1 reaches the registration roller pair 107 and the top sensor 108. The timing Tb in the graphic representation of FIG. 5 corresponds to the state illustrated in FIG. 4B. At the timing Tb, the leading end of the sheet S1 contacts with the registration roller pair 107, and the sheet S1 is then conveyed by the registration roller pair 107. At this time, the conveyance speed of the sheet S1 may fluctuate in some cases because of vibration after the contact with the registration roller pair 107 or the transmission of the conveyance force from the registration roller pair 107 to the sheet S1. Therefore, the rotation speed of the separation roller 105 that is driven and rotated by the sheet S1 may also fluctuate in some cases as illustrated in the timing Tb in the graphic representation in (iii) of FIG. 5.

Figure 4C:
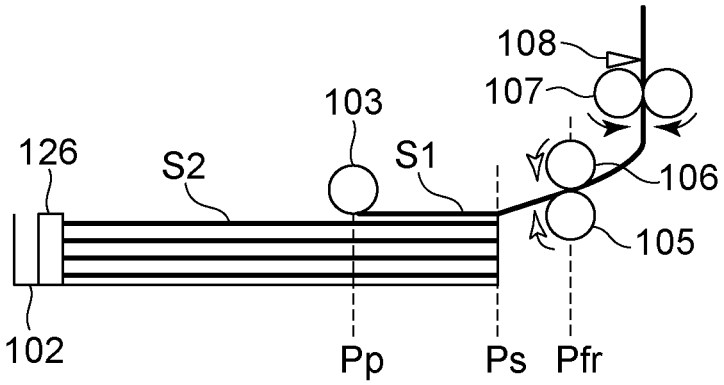

FIG. 4C illustrates a cross section of the cassette 102 at a timing when the rear end of the currently fed (conveyed) sheet S1 passes through the position Pp corresponding to the nip portion of the pick roller 103. The timing Tc in the graphic representation of FIG. 5 corresponds to the state illustrated in FIG. 4C. Herein, according to the present embodiment, the following control is performed to avoid paper jam since the sheet S2 loaded under the sheet S1 is pushed into the separation nip portion. That is, before the rear end of the sheet S1 passes through the position Pp corresponding to the nip portion of the pick roller 103, the driving control unit 210 switches the driving of the pick roller 103 from on to off at the timing t2 in the graphic representation of FIG. 5. Herein, the switching the driving of the pick roller 103 from on to off indicates that, while the driving control unit 210 continues the rotation of the motor 300, the electromagnetic clutch 301 is switched from on to off to interrupt the driving force of the motor 300. A timing t1 will be described below.

In addition, at this time, the driving of the feed roller 106 driven by the same driving source as that of the pick roller 103 is switched off. However, since the sheet S1 is conveyed by the registration roller pair 107 in the sheet feeding direction, the feed roller 106 and the separation roller 105 follow the sheet S1 and are driven and rotated. Although the driving of the pick roller 103 is switched from on to off at the timing t2, the separation roller 105 follows the sheet S1 conveyed by the registration roller pair 107 and continues to be driven and rotated. When the rear end of the sheet S1 passes through the position Pp corresponding to the nip portion of the pick roller 103, the influence of the frictional force applied to the sheet S1 by the pick roller 103 disappears. For this reason, vibration is generated in the sheet S1, and the rotation speed of the separation roller 105 may fluctuate in some cases as illustrated at the timing Tc in the graphic representation in (iii) of FIG. 5.

Figure 4D:
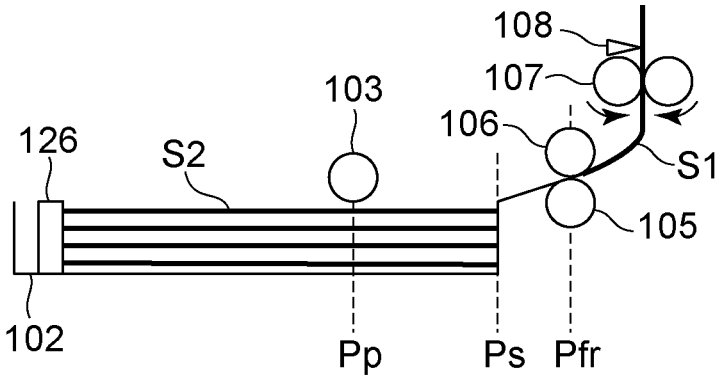

FIG. 4D illustrates a cross section of the cassette 102 at a timing when the rear end of the sheet S1 passes through the position Pfr of the separation nip portion of the feed roller 106 and the separation roller 105. The timing Td in the graphic representation of FIG. 5 corresponds to the state illustrated in FIG. 4D. As described in FIG. 5, since the rear end of the sheet S1 passes through the position Pfr corresponding to the separation nip portion, the rotation of the feed roller 106 and the separation roller 105 stops. The sheet S1 is conveyed by the registration roller pair 107 onto the downstream side in the sheet feeding direction. When the rear end of the sheet S1 passes through the top sensor 108, the signal of the top sensor 108 is changed from on to off.

New Product Detection of the Separation/Feed Rollers

Next, new product statuses of the separation roller 105 and the feed roller 106 and a change in the rotation speed of the separation roller 105 having the degraded conveyance performance in an end-of-life status of the roller will be described with reference to FIGS. 6A and 6B and FIGS. 7A and 7B. Hereinafter, the separation roller 105 and the feed roller 106 will be collectively referred to as a roller unit (rotary member unit).

Figure 5:
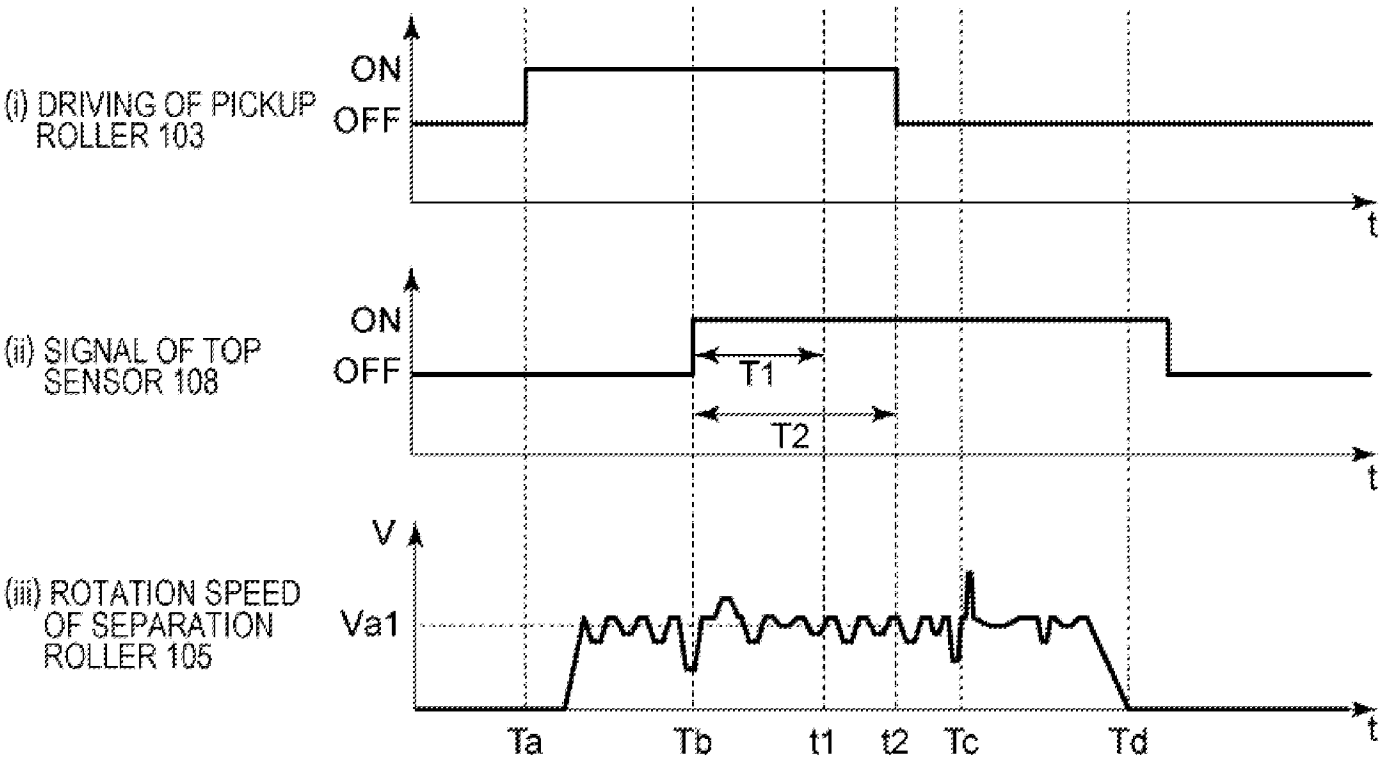
FIG. 5 is a timing chart in a case where the sheet feeding control is executed according to the first embodiment.
Figure 6A:
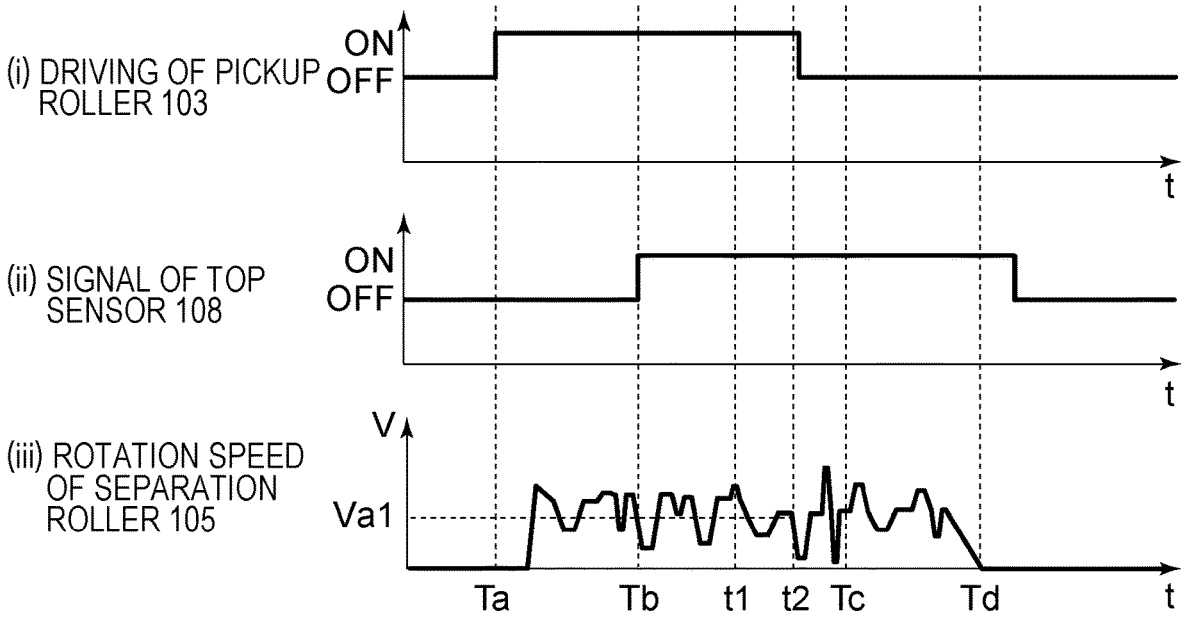
FIGS. 6A and 6B are graphical representations of rotations in end-of-life statuses of separation/feed rollers.
Figure 6B:
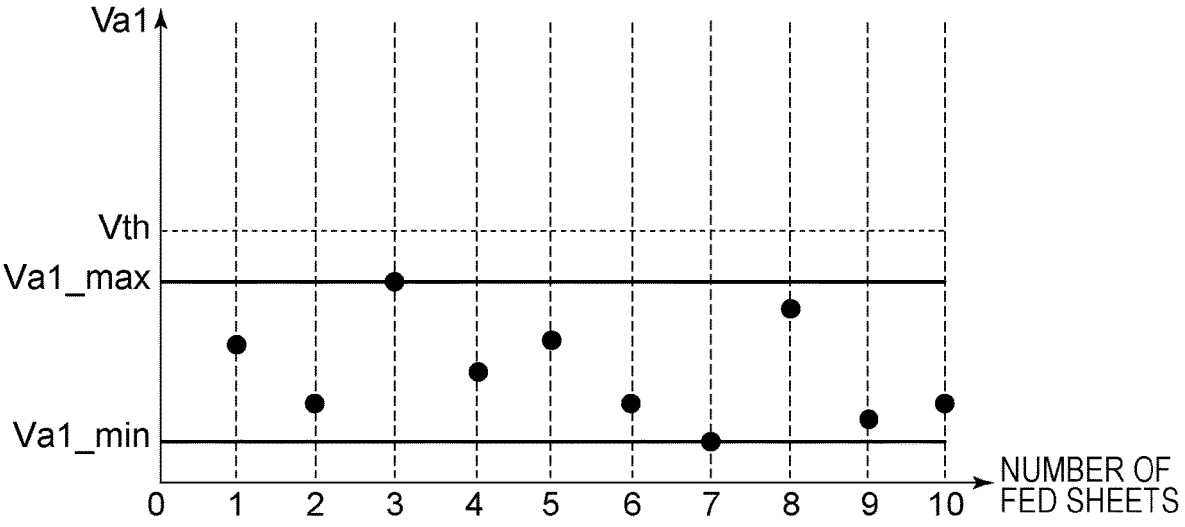
Figure 7A:
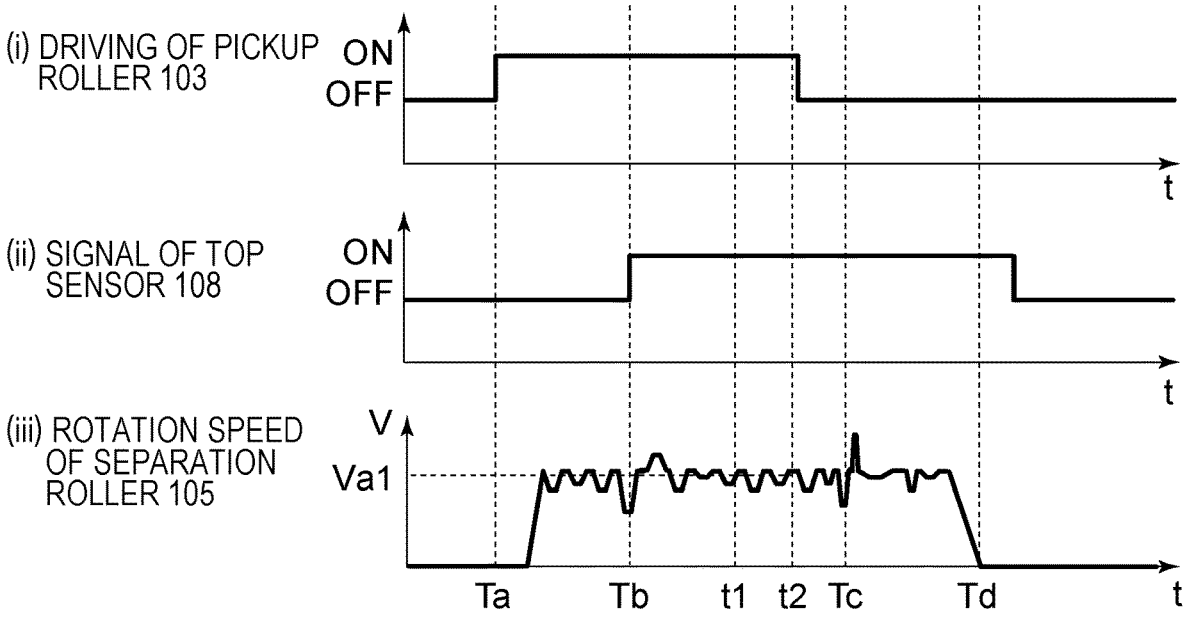
FIGS. 7A and 7B are graphical representations of rotations in new product statuses of the separation/feed rollers.
Figure 7B:
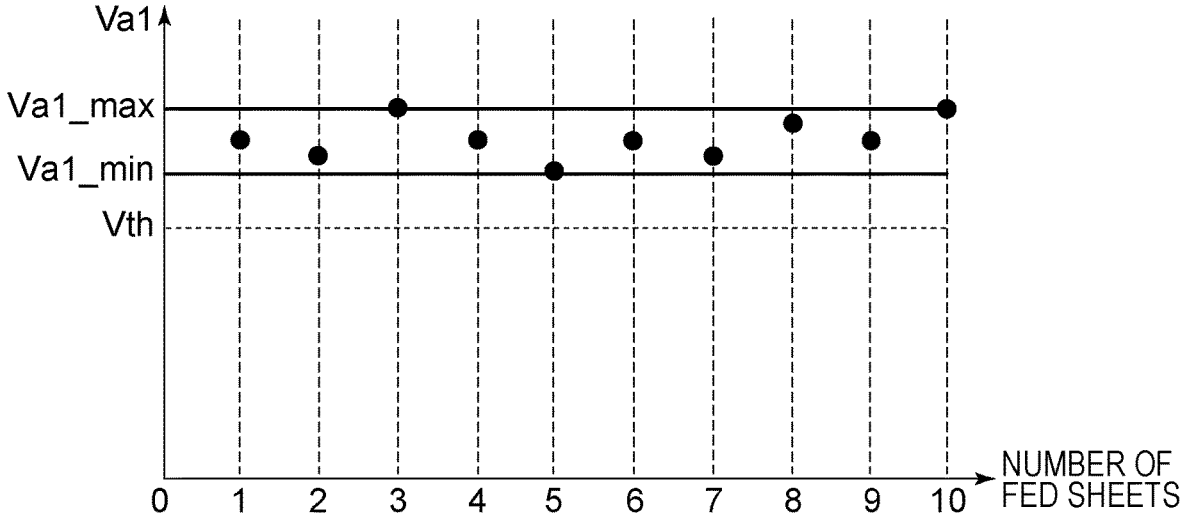

FIGS. 6A and 6B are graphic representations in the end-of-life status in which the conveyance performance of the roller unit is degraded, and FIGS. 7A and 7B are graphic representations when the roller unit is in the new product status. Herein, (i) to (iii) in FIGS. 6A and 6B and FIG. 7A indicate parameters similar to (i) to (iii) in FIG. 5. That is, the parameters respectively indicate on or off states of the pick roller 103 and the top sensor 108 and the rotation speed of the separation roller 105 in a case where the single sheet S is fed in accordance with the sheet feeding control illustrated in FIGS. 4A to 4D. Herein, an average speed (average value) of the rotation speed of the separation roller 105 a previously set period from the timing t1 until the timing t2 is set as Va1. With this configuration, since the average value Va1 from the timing t1 until the timing t2 can be obtained each time the single sheet S is fed, one piece of data can be obtained each time the single sheet S is fed.

Herein, a period for obtaining the average value Va1 of the rotation speed of the separation roller 105 is set by avoiding a timing when the rotation speed of the separation roller 105 is likely to fluctuate such as the timing Tb or the timing Tc described above. According to the first embodiment, the period for obtaining the average value Va1 is set as a period the separation roller 105 is driven and rotated by following the sheet S conveyed by the registration roller pair 107 after the leading end of the fed sheet S enters the registration roller pair 107. The previously set timing t1 is a starting timing for the period for obtaining the average value Va1 and is set while the average value Va1 can be obtained by avoiding the timing when the rotation of the separation roller 105 is likely to fluctuate. Herein, a time from when the leading end of the sheet S reaches the top sensor 108 until the timing t1 is set as a time T1, and a time from when the leading end of the sheet S reaches the top sensor 108 until the timing t2 is set as a time T2 (see FIG. 5).

FIGS. 6A and 6B will be described in detail. As described above, FIGS. 6A and 6B are graphic representations of the end-of-life status in which the conveyance performance of the roller unit is degraded. In the roller end-of-life status, the separation roller 105 and the feed roller 106 have the substantially lower frictional force with respect to the sheet S because of the friction or adhesion of the paper powder onto the roller, and the conveyance performance is degraded. As a result, adaptability (follow-up property) of the separation roller 105 with respect to the sheet S is degraded. Then, as illustrated in FIG. 6A, the rotation speed of the separation roller 105 during the conveyance of the sheet S is substantially lowered or disturbed. In some cases, the rotation of the separation roller 105 may stop or rotate in the direction to disturb the sheet feeding while exceeding the force by the friction of the rotational load of the torque limiter 302 against the sheet S.

FIG. 6B illustrates the average value Va1 of the rotation speed of the separation roller 105 in a case where the ten sheets S are fed. In FIG. 6B, the horizontal axis indicates the number of fed sheets, and the vertical axis indicates the average value Va1 of the rotation speed of the separation roller 105. Herein, in a case where the ten sheet S are fed, ten pieces of data can be obtained as the average value Va1 of the rotation speed of the separation roller 105. Herein, a lowest value of the rotation speed of the separation roller 105 when the roller unit is in the new product status is set as a threshold speed Vth. As illustrated in FIG. 6B, in the roller end-of-life status, the conveyance performance of the separation roller 105 and the feed roller 106 is degraded, and the adaptability of the separation roller 105 with respect to the sheet S is degraded. Thus, the average value Va1 of the rotation speed of the separation roller 105 becomes lower than the threshold speed Vth.

A maximum value of the ten average values Va1 is set as Va1_max, and a maximum value thereof is set as Va1_min. With this configuration, it is conceivable that a difference between the maximum value Va1_max and the minimum value Va1_min of the average values Va1 of the separation roller 105 is the variation of the average value Va1 of the rotation speed of the separation roller 105. As illustrated in FIG. 6B, since the rotation speed of the separation roller 105 is not stable in the roller end-of-life status, the variation of the average value Va1 of the rotation speed of the separation roller 105 is also increased.

FIGS. 7A and 7B will be described in detail. As described above, FIGS. 7A and 7B are graphic representation when the roller unit is in the new product status. As illustrated in FIG. 7A, since the speed reduction caused by the roller friction or the like does not occur in the roller new product status, the rotation speed of the separation roller 105 during the conveyance of the sheet S is stabilized at a higher speed than that in the roller end-of-life status. For this reason, as illustrated in FIG. 7B, the average value Va1 of the rotation speed of the separation roller 105 is higher than or equal to the threshold speed Vth. In addition, since the rotation of the separation roller 105 is stable, the variation of the average value Va1 of the rotation speed of the separation roller 105 is small. Therefore, it is possible to determine whether or not the roller unit is a new product depending on determining whether or not the average value Va1 of the rotation speed of the separation roller 105 is higher than or equal to the threshold speed Vth or whether or not the variation of the average value Va1 is lower than the threshold.

Influence in a Case Where the Paper Powder Adhered onto the Roller is Removed

Even when the paper powder is adhered onto the separation roller 105 or the feed roller 106 to degrade the conveyance performance, the rotation speed of the separation roller 105 may temporarily change to an equivalent level to the roller new product since the paper powder adhered onto the roller is removed at the time of processing for jammed paper or the like.

Figure 8A:
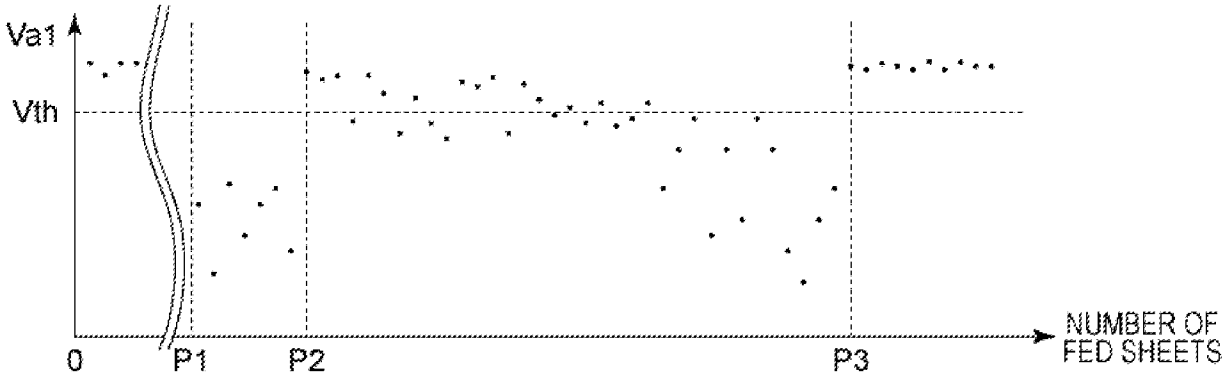
FIGS. 8A and 8B are graphical representations of a relationship among the number of fed sheets, a separation roller rotation speed, and a sheet feeding time according to the first embodiment.

FIG. 8A is a graphic representation indicating transition of the average value Va1 of the rotation speed of the separation roller 105 in a case where the paper powder adhered onto the roller is removed. The horizontal axis in FIG. 8A indicates the number of fed sheets S. When the number of fed sheets is approximately 0, that is, the separation roller 105 and the feed roller 106 are in the new product status, the average value Va1 of the rotation speed of the separation roller 105 is higher than or equal to the threshold speed Vth, and the variation is also small as described above. At the number P1 of fed sheets, the separation roller 105 and the feed roller 106 are in the roller end-of-life status in which the conveyance performance is degraded because of the roller friction and the paper powder adhesion. As described above, the average value Va1 of the rotation speed of the separation roller 105 at this time becomes shorter than the threshold speed Vth, and the variation is also large. At the number P2 of fed sheets, the paper powder adhered onto the separation roller 105 or the feed roller 106 is removed. As a result, the adaptability of the separation roller 105 with respect to the sheet S is temporarily refined, and the rotation speed of the separation roller 105 is stabilized in some cases. At this time, the average value Va1 of the rotation speed of the separation roller 105 is higher than or equal to the threshold speed Vth, and the variation may also be decreased in some cases.

It should be noted however that the conveyance performance of the separation roller 105 and the feed roller 106 may be degraded in some cases by not only the paper powder but also the roller friction in the roller end-of-life status. For this reason, at the number P2 of fed sheets, after the paper powder is removed, data indicating that the average value Va1 of the rotation speed of the separation roller 105 is higher than or equal the threshold speed Vth and data indicating that the average value Va1 is lower than the threshold speed Vth may temporarily exist in a mixed manner in some cases. In addition, a period in which the variation of the average value Va1 of the rotation speed of the separation roller 105 is large and a period in which the variation is small may exist in a mixed manner in some cases.

At the number P2 of fed sheets and thereafter, as the number of fed sheets is further increased, the average value Va1 of the rotation speed of the separation roller 105 becomes more similar to the roller end-of-life status as in the case at the number P1 of fed sheets again because of the influence of the paper powder adhered onto the roller again and the influence of the roller friction up to the number P2 of fed sheets. In this manner, in a case where the paper powder adhered onto the roller is removed, an erroneous detection may be performed when the roller new product is determined based on only the average value Va1 of the rotation speed of the separation roller 105 or the variation of the average value Va1.

In view of the above, to avoid the above-described erroneous detection, the roller new product is, determined based on a sheet feeding time (feeding or conveyance time) in addition to the average value Va1 of the rotation speed of the separation roller 105 or the variation of the average value Va1. Herein, the sheet feeding time refers to a time from when the feeding of the sheet S is started by the pick roller 103 is started until the top sensor 108 detects the leading end of the sheet S.

Figure 8B:
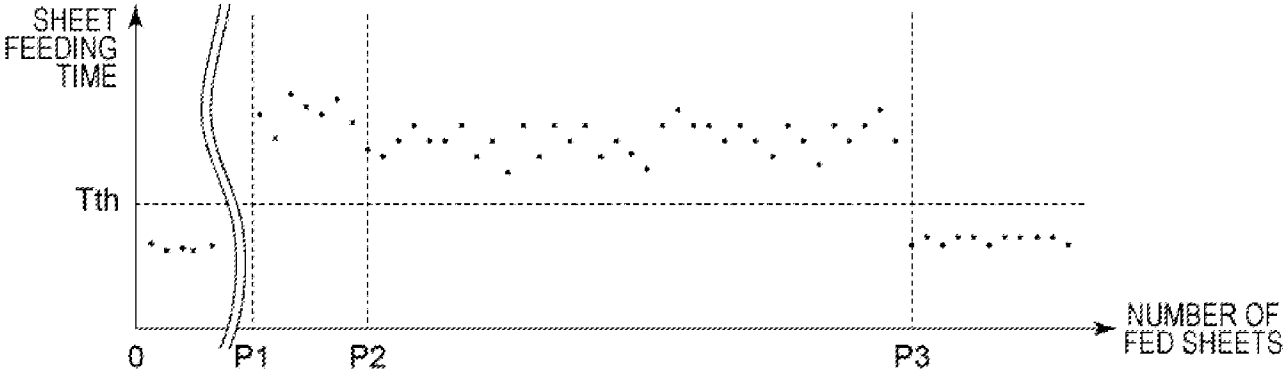

FIG. 8B is a graphic representation indicating transition of the sheet feeding time in a case where the paper powder adhered onto the roller is removed. The horizontal axis in FIG. 8B indicates the number of fed sheets S. The sheet feeding time in the roller new product status is shorter than a threshold time Tth since the conveyance performance of the separation roller 105 and the feed roller 106 is not degraded. Herein, the threshold time Tth is set as a value higher than the maximum value of the sheet feeding time in the roller new product and lower than the minimum value of the sheet feeding time in the roller end-of-life status. The sheet feeding time at the number P1 of fed sheets becomes higher than the threshold time Tth along the degradation in the conveyance performance of the separation roller 105 and the feed roller 106. With regard to the sheet feeding time at the number P2 of fed sheets, the conveyance force of the separation roller 105 and the feed roller 106 is temporarily increased since the paper powder is removed, and the sheet feeding time is also influenced in the direction to be shortened. However, since the influence caused by the roller friction is more dominant than the influence caused by the paper powder in the roller end-of-life status, the sheet feeding time remains higher than the threshold time Tth unlike the average value Va1 of the rotation speed of the separation roller 105 even in a case where the paper powder adhered onto the roller is removed. At the number P3 of fed sheets, the separation roller 105 and the feed roller 106 are replaced with new product (unused) rollers. At the number P3 of fed sheets and thereafter, with regard to the average value Va1 of the rotation speed of the separation roller 105, like the new product status described above, the variation of the average value Va1 of the rotation speed of the separation roller 105 is small even when the speed is higher than or equal to the threshold speed Vth, and also the sheet feeding time becomes smaller than the threshold time Tth.

Therefore, when the roller new product is determined in a case where the average value Va1 of the rotation speed of the separation roller 105 is higher than or equal to the threshold speed Vth or the variation of the average value Va1 is lower than the threshold and also the sheet feeding time is shorter than the threshold time Tth, it is possible to avoid the erroneous detection. As a result, even in a case where the paper powder adhered onto the roller is removed, it is possible to determine that the roller unit is equivalent to the new product.

Influence of the Multiple Feed of the Subsequent Sheet by the Frictional Force Between the Sheets Two or more sheets (for example, the sheet S1 and the sheet S2) are overlapped with one another and conveyed to the separation nip portion by the frictional force acting between the sheets S loaded in the cassette 102 in some cases when the single sheet S1 is intended to be fed. This phenomenon is referred to as multiple feed. The rotation speed of the separation roller 105 and the sheet feeding time in a case where the multiple feed occurs will be described.

First, an influence when the average value Va1 of the rotation speed of the separation roller 105 is obtained will be described. In a case where the multiple feed occurs and the leading end of the sheet S2 reaches the position Pfr corresponding to the separation nip portion before the calculation of Va1, the rotation speed of the separation roller 105 is already lower than or equal to 0 when the calculation of Va1 is started. Herein, a time before the calculation of Va1 is started is before the timing t1 in FIG. 5. In a case where the leading end of the sheet S2 reaches the position Pfr corresponding to the separation nip portion after the start of the calculation of Va1 before the end of the calculation of Va1, since the rotation speed of the separation roller 105 becomes lower than or equal to 0 in the midcourse of the calculation of Va1, Va1 is not normally measured, and a measurement result of a value lower than the normal time is obtained. Herein, a period after the start of the calculation of Va1 before the end of the calculation of Va1 is a period from the timing t1 until the timing t2 in FIG. 5. In a case where the leading end of the sheet S2 reaches the position Pfr corresponding to the separation nip portion after the calculation of Va1, Va1 can be normally measured. Herein, a time after the end of the calculation of Va1 is a time at and after the timing t2 in FIG. 5.

In view of the above, according to the present embodiment, when the minimum value at which the average value Va1 of the rotation speed of the separation roller 105 may be normally measured is set as Vath, in a case where the average value Va1 is lower than the threshold Vath, it is determined that exists the leading end of the subsequent sheet S2 at the separation nip portion. Then, the roller new product determination is not performed by using the average value Va1 data.

Next, an influence when the sheet feeding time is obtained will be described. In a case where the subsequent sheet S2 is taken out to the separation nip portion as a result of as the multiple feed because of the influence of the friction, the feeding of the subsequent sheet S2 is started in a state in which the leading end is at the position Pfr corresponding to the separation nip portion. As a result, the feeding time of the subsequent sheet S2 is shortened by the amount corresponding to the distance from Ps to Pfr as compared with a case where the leading end is at the leading end position Ps of the sheet S while being positioned by the rear end regulating plate 126. According to this, in a case where the multiple feed to the separation nip portion occurs, even when the roller unit is not replaced with the new product, there is a fear that the average value Va1 becomes higher than the threshold speed Vth, and the sheet feeding time becomes shorter than the threshold time Tth. As a result, there is a fear that it is erroneously detected that the roller is replaced with the new product.

In view of the above, according to the present embodiment, in a case where the rotation speed of the separation roller 105 becomes 0 or lower at a timing before the timing Td when the rear end of the sheet S1 in FIG. 5 passes through the separation nip portion, it is determined that the leading end of the subsequent sheet S2 exists at the separation nip portion. Then, the roller new product determination is not performed by using the sheet feeding time data of the subsequent sheet S2.

It should be noted however that, in the case of the first sheet feeding after the cassette 102 is inserted into the printer 101, the movement of the leading end position by the frictional force acting between the sheets S does not occur. For this reason, in the case of the first sheet feeding after the cassette 102 is inserted into the printer 101, the roller new product determination is performed by using the sheet feeding time data without depending on the rotation speed of the separation roller 105 at the time of the previous sheet feeding. With this configuration, it is possible to avoid the erroneous detection of the roller new product because of the multiple feed due to the leading end position of the subsequent sheet.

Roller Unit New Product Determination Processing

Figure 9:
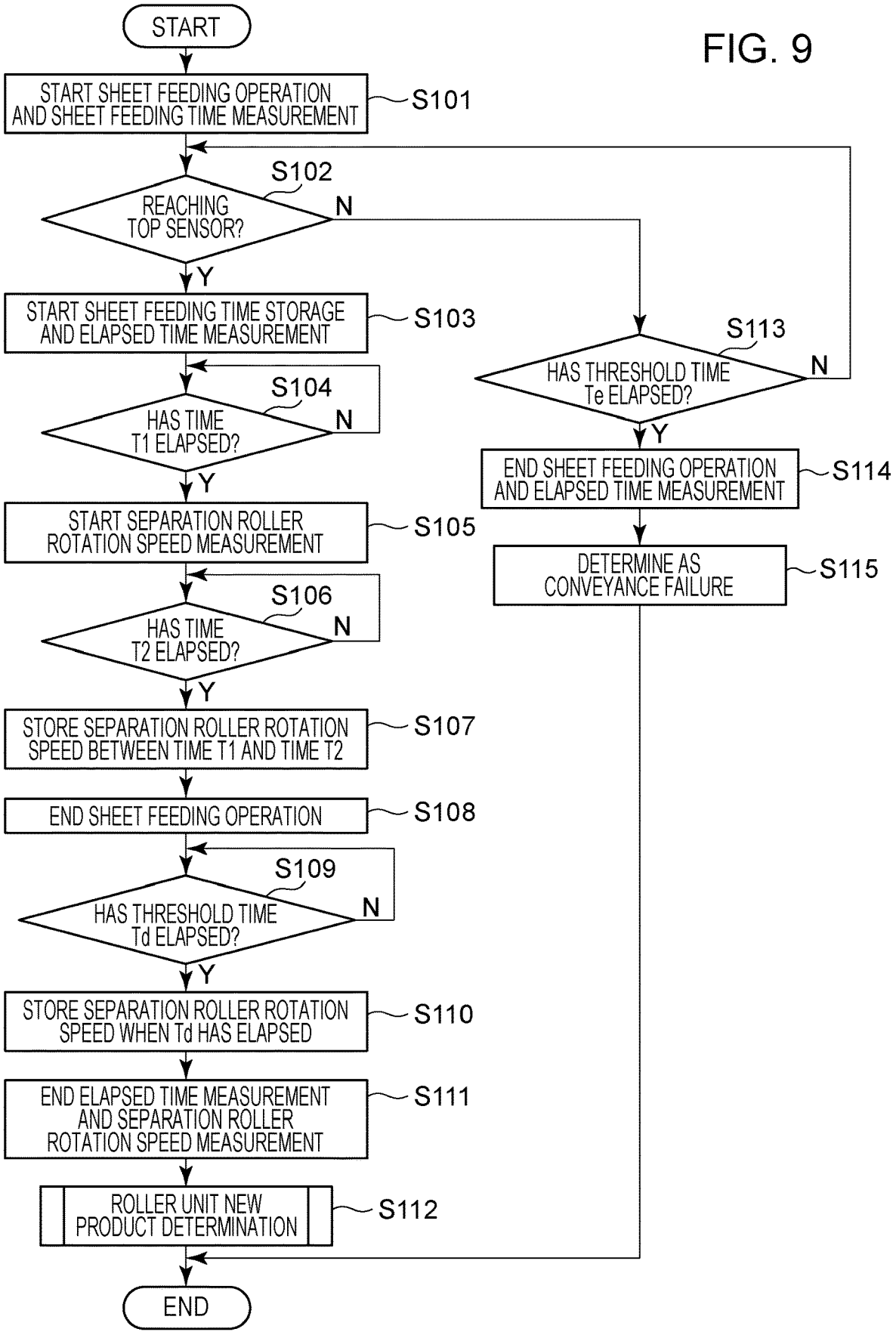
FIG. 9 is a flow chart illustrating new product determination processing according to the first embodiment.
Figure 10:
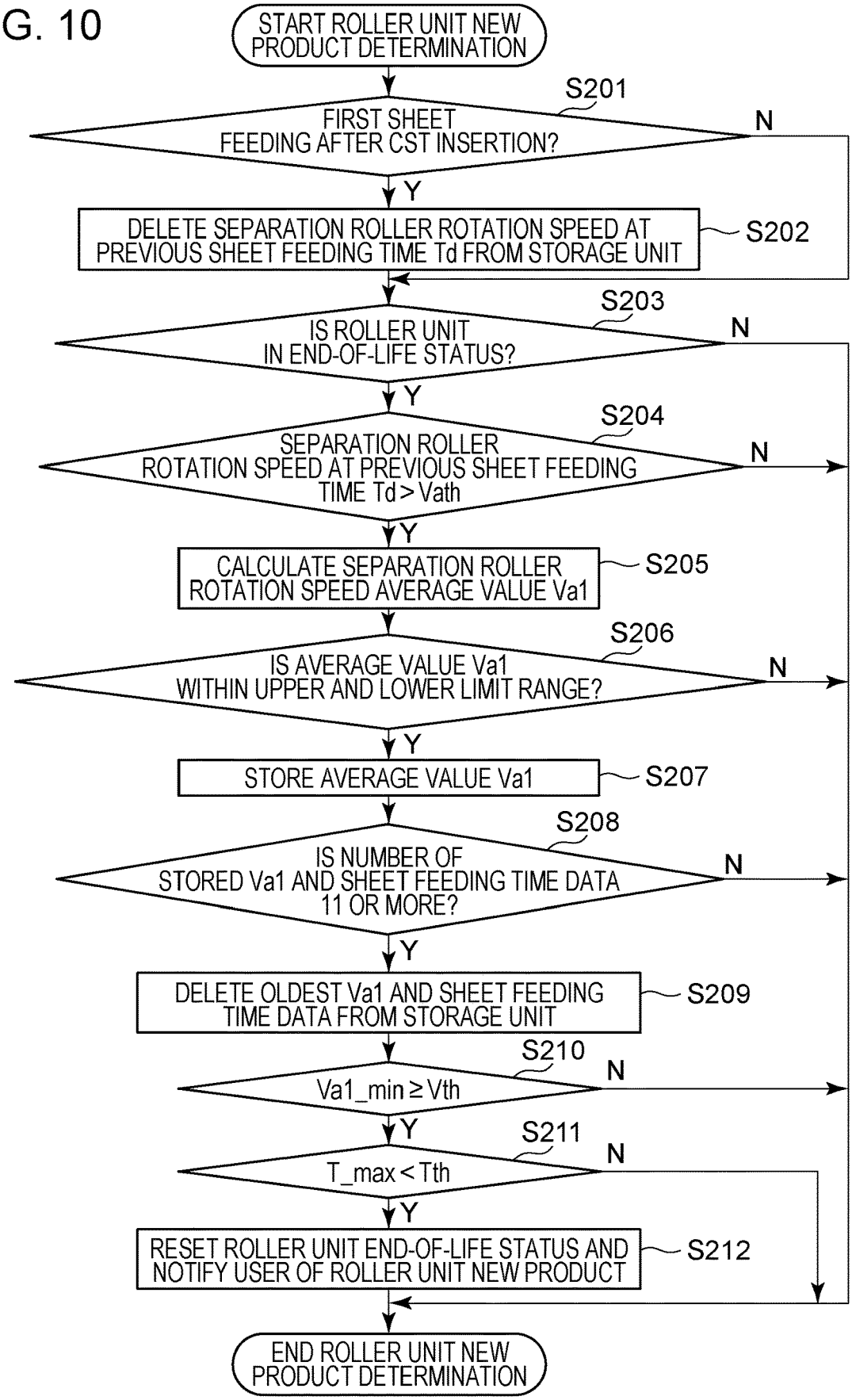
FIG. 10 is a flow chart illustrating the new product determination processing of the separation/feed rollers according to the first embodiment.

A new product determination method for the roller unit according to the first embodiment will be described with reference to flow charts of FIG. 9 and FIG. 10. Control based on the flow charts of FIG. 9 and FIG. 10 is executed by the engine control unit 201 installed in the image forming apparatus control unit 200 based on the program stored in the storage unit 209 such as the ROM.

First, FIG. 9 will be described. In step (hereinafter, referred to as S) 101, the engine control unit 201 transmits an instruction for starting sheet feeding to the driving control unit 210 to start the sheet feeding operation. The engine control unit 201 also starts the measurement of the sheet feeding time by the measurement unit 206. In S102, the engine control unit 201 determines whether or not the top sensor 108 detects the leading end of the sheet S. The engine control unit 201 determines that the leading end of the sheet S is detected in accordance with the change of the signal output from the top sensor 108 from off to on. In S102, in a case where the engine control unit 201 determines that the top sensor 108 detects the leading end of the sheet S, the processing proceeds to S103. In S102, in a case where the engine control unit 201 determines that the top sensor 108 does not detect the leading end of the sheet s the processing proceeds to S113.

In S103, the engine control unit 201 stores the time from when the sheet feeding operation is started until the top sensor 108 detects the leading end of the sheet S which is measured by the measurement unit 206 in the storage unit 209. The engine control unit 201 also starts the measurement of the elapsed time from the timing when the sheet S reaches the top sensor 108 by the measurement unit 206. In S104, the elapsed time since the engine control unit 201 determines whether or not the top sensor 108 reaches the leading end of the sheet S has elapsed the time T1. In S104, in a case where the engine control unit 201 determines that the elapsed time has not elapsed the time T1, the processing returns to S104, and the measurement unit 206 continues measuring the elapsed time since the leading end of the sheet S has reached the top sensor 108. In S104, in a case where the engine control unit 201 determines that the elapsed time has elapsed the time T1, the processing proceeds to S105.

In S105, the engine control unit 201 starts the measurement of the rotation speed of the separation roller 105 by the measurement unit 206 based on the rotation state of the separation roller 105 which is detected by the encoder 203. In S106, the engine control unit 201 determines whether or not the elapsed time since the leading end of the sheet S has reached the top sensor 108 has elapsed the time T2. In S106, in a case where the engine control unit 201 determines that the elapsed time has not elapsed the time T2, the processing returns to S106 and continues measuring the elapsed time since the leading end of the sheet S has reached the top sensor 108 by the measurement unit 206. In S106, in a case where the engine control unit 201 determines that the elapsed time has elapsed the time T2, the processing proceeds to S107.

In S107, the engine control unit 201 stores the rotation speed of the separation roller 105 which is measured by the measurement unit 206 after the elapse of the time T1 until the elapse of the time T2 in the storage unit 209. In S108, the engine control unit 201 ends the sheet feeding operation by the driving control unit 210. It should be noted that the end of the sheet feeding operation herein indicates the control for switching the electromagnetic clutch 301 from on to off while the rotation of the motor 300 continues. That is, since the motor 300 continues rotating, the sheet S is conveyed to the image forming unit by the registration roller pair 107.

In S109, the engine control unit 201 determines whether or not the elapsed time since the leading end of the sheet S has reached the top sensor 108 has elapsed the time Td. In S109, in a case where the engine control unit 201 determines that the elapsed time has not elapsed the time Td, the return returns to S109, and the elapsed time since the leading end of the sheet S has reached the top sensor 108 is continuously measured by the measurement unit 206. In S109, in a case where the engine control unit 201 determines that the elapsed time has elapsed the time Td, in S110, the rotation speed of the separation roller 105 upon the elapse of the time Td which is measured by the measurement unit 206 is stored in the storage unit 209, and the processing proceeds to S111.

In S111, the engine control unit 201 ends the measurement of the rotation speed of the separation roller 105 and the measurement of the elapsed time by the measurement unit 206, and the processing proceeds to S112. In S112, the determination unit 207 of the engine control unit 201 determines whether or not the roller unit is the new product based on the rotation speed of the separation roller 105 and the sheet feeding time which are measured by the measurement unit 206, and the processing is ended. The processing in S112 will be described in detail below.

In S113, the engine control unit 201 determines whether or not the sheet feeding time currently measured by the measurement unit 206 exceeds a threshold time Te set for determining that a feeding failure occurs. In S113, in a case where the engine control unit 201 determines that the elapsed time does not exceed the threshold time Te, the processing returns to S102, and the driving control unit 210 maintains the driving of the pick roller 103 to continue the sheet feeding operation. In S113, in a case where the engine control unit 201 determines that the elapsed time exceeds the threshold time Te, the processing proceeds to S114. In S114, the engine control unit 201 stops the driving of the pick roller 103 by the driving control unit 210 to end the sheet feeding operation and also end the measurement of the sheet feeding time by the measurement unit 206. In S115, the engine control unit 201 determines that a conveyance malfunction such as a delayed print error has occurred, for example, and notifies the user that the conveyance malfunction has occurred via the panel 211 or the external device to end the processing.

Next, a detail of the new product determination processing for the roller unit in S112 will be described with reference to FIG. 10. In S201, the engine control unit 201 determines whether or not this is the first sheet feeding after the cassette 102 is inserted into the printer 101. In S201, in a case where the engine control unit 201 determines that this is the first sheet feeding after the cassette 102 is inserted into the printer 101, the rotation speed data of the separation roller 105 upon the elapse of the time Td at the time of the previous sheet feeding which is stored in the storage unit 209 in S202 is deleted, and the processing proceeds to S203. In S201, in a case where the engine control unit 201 determines that this is not the first sheet feeding after the cassette 102 is inserted into the printer 101, the processing proceeds to S203.

In S203, the engine control unit 201 determines whether or not the status of the roller unit is the end-of-life status. For example, in a case where the number of fed sheets reaches a recommended value for the roller replacement, the engine control unit 201 can determine that the roller unit is in the end-of-life status. In a case where the average value Va1 of the rotation speed of the separation roller 105 is below a threshold a predetermined number of times in succession or a case where the variation of the average value Va1 of the rotation speed of the separation roller 105 exceeds a threshold a predetermined number of times in succession, it may be similarly determined that the roller unit is in the end-of-life status. When the engine control unit 201 determines that the roller unit is in the end-of-life status, the engine control unit 201 changes the status to the end-of-life status. Herein, the method of determining whether or not the roller unit is in the end-of-life status is not limited to the above-described method. In S203, in a case where the engine control unit 201 determines that the status of the roller unit is the end-of-life status, the processing proceeds to S204. In S201, in a case where the engine control unit 201 determines that the status of the roller unit is not the end-of-life status, the new product determination for the roller unit is ended.

In S204, in a case where the rotation speed data of the separation roller 105 upon the elapse of the time Td at the time of the previous sheet feeding is higher than the previously set threshold Vath, the engine control unit 201 advances the processing to S205. In S204, in a case where the rotation speed data of the separation roller 105 upon the elapse of the time Td at the time of the previous sheet feeding is lower than or equal to the previously set threshold Vath, the engine control unit 201 ends the new product determination for the roller unit.

In S205, the engine control unit 201 reads out the information of the rotation speed of the separation roller 105 since the time T1 has elapsed until the time T2 has elapsed. The engine control unit 201 calculates the average value Va1 of the rotation speed of the separation roller 105 in a period since the time T1 has elapsed until the time T2 has elapsed. In S206, the engine control unit 201 determines whether or not the average value Va1 of the rotation speed of the separation roller 105 which is calculated in S205 is within a range of an upper limit and a lower limit of the previously set average value Va1 (hereinafter, referred to as within an upper and lower limit value range). In S206, in a case where the engine control unit 201 determines that the calculated average value Va1 of the rotation speed of the separation roller 105 is out of the upper and lower limit value range, the new product determination for the roller unit is ended.

In S206, in a case where the engine control unit 201 determines that the average value Va1 of the rotation speed of the separation roller 105 is within the previously set upper and lower value range, the processing proceeds to S207. In S207, the engine control unit 201 stores the average value Va1 of the rotation speed of the separation roller 105 which is calculated in S205 in the storage unit 209. It should be noted that when the average value Va1 of the rotation speed of the separation roller 105 is stored in the storage unit 209, the sheet feeding time data measured at the time of the sheet feeding when the rotation speed of the separation roller 105 is stored is also stored.

In S208, the engine control unit 201 determines whether or not the number of data pieces of the average value Va1 of the rotation speed of the separation roller 105 stored in the storage unit 209 is higher than or equal to, for example, 11. Herein, the number of data pieces stored in the storage unit 209 is not limited to 11. In S208, in a case where the engine control unit 201 determines that the number of data pieces stored in the storage unit 209 is lower than 11, the new product determination for the roller unit is ended. In S208, in a case where the engine control unit 201 determines that the number of data pieces stored in the storage unit 209 is higher than or equal to 11, the processing proceeds to S209.

In S209, the engine control unit 201 deletes the single oldest data piece among the 11 pieces of data of the average value Va1 of the rotation speed of the separation roller 105 which are stored in the storage unit 209. The engine control unit 201 further deletes the single oldest data piece among the 11 pieces of sheet feeding time data which are measured at the same sheet feeding time as the data pieces of the average value Va1 of the rotation speed of the separation roller 105 which are stored in the storage unit 209.

In S210, the engine control unit 201 extracts the minimum value Va1_min from among the ten data pieces of the average value Va1 stored in the storage unit 209, and in a case where the minimum value Va1_min is higher than or equal to the threshold speed Vth, the processing proceeds to S211. In S210, in a case where the minimum value Va1_min is lower than the threshold speed Vth, the engine control unit 201 ends the new product determination for the roller unit.

In S211, the engine control unit 201 extracts a maximum value T_max from among the ten pieces of sheet feeding time data measured at the same sheet feeding time as the ten pieces of data of the average value Va1 stored in the storage unit 209. In a case where the maximum value T_max is lower than the threshold time Tth, the engine control unit 201 advances the processing to S212. In a case where the maximum value T_max is higher than or equal to the threshold time Tth, the new product determination for the roller unit is ended.

In S212, the engine control unit 201 determines that the roller unit is the new product and changes the status to the new product status. The engine control unit 201 notifies the user that the roller unit is the new product by using the panel 211 by the panel output unit 208 and ends the roller unit new product determination.

Herein, in S210, it is determined as to whether or not the minimum value Va1_min is higher than or equal to the threshold speed Vth, but as described above, the determination may be performed based on the variation of the average value Va1 of the rotation speed of the separation roller 105. The engine control unit 201 extracts the maximum value Va1_max and the minimum value Va1_min from among the ten pieces of data of the average value Va1 stored in the storage unit 209 and obtains a difference between the maximum value Va1_max and the minimum value Va1_min. The engine control unit 201 determines whether or not the difference between the maximum value Va1_max and the minimum value Va1_min, that is, the variation of the average value Va1 of the rotation speed of the separation roller 105 is lower than or equal to a threshold speed Vd for determining that the roller unit is the new product. In S210, in a case where the difference between the maximum value Va1_max and the minimum value Va1_min is lower than or equal to the threshold speed Vd, the engine control unit 201 advances the processing to S211. In S210, in a case where the difference between the maximum value Va1_max and the minimum value Va1_min is higher than the threshold speed Vd, the engine control unit 201 ends the new product determination for the roller unit.

Furthermore, the variation of the average value Va1 of the rotation speed of the separation roller 105 is set as the difference between the maximum value and the minimum value of the data recorded in the storage unit 209, but a standard deviation, a variance, or the like of the data recorded in the storage unit 209 may also be used. The number of data pieces of the average value Va1 of the rotation speed which are stored in the storage unit 209 may also be changed to the appropriate number of data pieces depending on the method of calculating the variation.

According to the method of determining whether or not the roller unit is the new product based on the variation of the average value Va1 of the rotation speed of the separation roller 105, an influence from an environment, a variation of parts, or the like can be reduced as compared with the method depending on whether or not the average value Va1 is higher than or equal to the threshold speed Vth. Even in a case where an average rotation speed of the separation roller 105 varies depending on an environment such as temperature and humidity or a variation of parts, when a magnitude of the variation indicating the stability of the adaptability of the separation roller 105 with respect to the sheet S is actually checked, it is possible to minimize the influence from the difference in the average rotation speed. In addition, a frictional coefficient of a sheet surface, a weight, or the like varies a paper category (type) of the sheet S varies, and the behavior of the rotation speed of the separation roller 105 changes. To take this influence into account, the rotation state of the separation roller 105 during a period in which the separation roller 105 is driven by the friction against the sheet S is monitored instead of a period in which the separation roller 105 contacts with the feed roller 106 to be driven. With this configuration, the influence affecting the conveyance performance depending on the paper type is also taken into account, and it is possible to more accurately determine the end-of-life status of the separation roller.

In addition, to avoid the erroneous detection by unexpected abnormality data, the new product determination for the roller unit may perform the following determination. For example, in a case where the average value Va1 of the rotation speed of the separation roller 105 and the sheet feeding time or the variation of the average value Va1 and the sheet feeding time exceed the thresholds plural times in succession within a predetermined period of time, it may be determined as the new product of the roller unit.

In addition, the thresholds for the average value Va1 of the rotation speed of the separation roller 105 and the sheet feeding time may be changed depending on the environment or the paper type. Furthermore, in a case where the environment significantly changes from the previous sheet feeding and a case where the paper type is changed, to avoid the erroneous detection for the new product of the roller unit due to the influence from the above-described circumstances affecting the average value Va1 of the rotation speed of the separation roller 105 and the sheet feeding time, a configuration may also be adopted in which the determination of the new product detection is not performed for a period of time.

With the above-described configuration, according to the present embodiment, it is possible to determine whether or not the roller unit (the separation roller 105 and the feed roller 106) is the new product status based on the rotation information of the separation roller 105. When it is detected that the image forming apparatus is replaced with the new product after the roller unit is put into the end-of-life status and the status is automatically changed, it is possible to detect the end-of-life status again even for the roller after the replacement. With this configuration, even in a case where the user, the service man, or the like forgets resetting the end-of-life status after the replacement of the new product of the roller unit, it becomes possible to accurately determine the end-of-life status of the replaced unit, and a future conveyance malfunction such as a print failure can be avoided in advance.

Second Embodiment

A second embodiment will be described. The descriptions of the main parts are similar to the first embodiment, and only parts different from the first embodiment will be described herein.

Descriptions on the Sheet Feeding Control

Figure 11A:
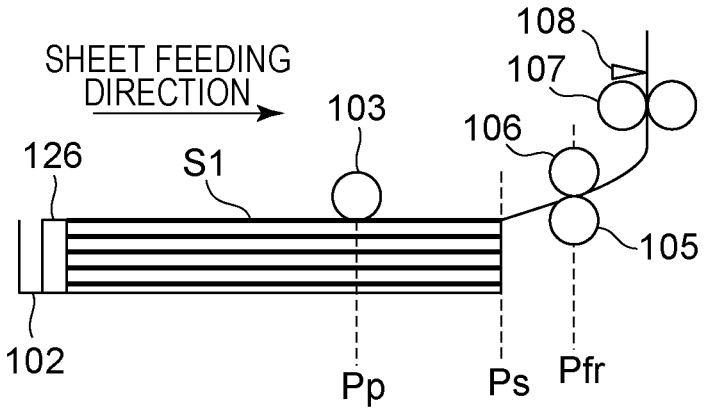
FIGS. 11A to 11D are explanatory diagrams for describing the operation of the sheet feeding control according to a second embodiment.

First, the sheet feeding control of the printer 101 according to the second embodiment will be described with reference to FIGS. 11A to 11D and FIG. 12. FIGS. 11A to 11D and FIG. 12 respectively correspond to FIGS. 4A to 4D and FIG. 5 according to the first embodiment. It should be noted that FIG. 11A illustrates the same state as FIG. 4A, and the descriptions will be omitted. The timing Ta in the graphic representation of FIG. 12 corresponds to the state illustrated in FIG. 11A.

Figure 11B:
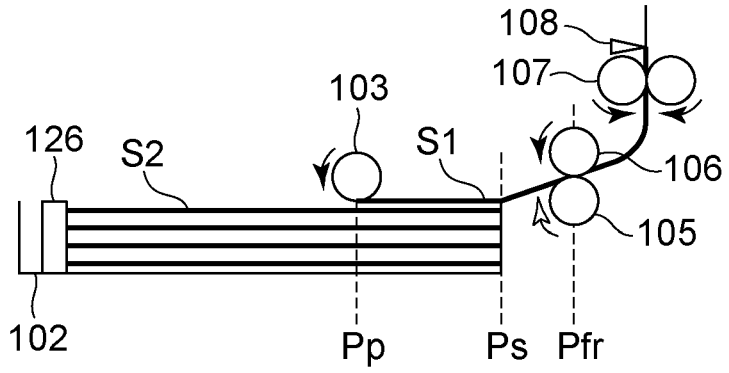

FIG. 11B illustrates a cross section of the cassette 102 at a timing when the rear end of the currently fed sheet S1 passes through the position Pp corresponding to the nip portion of the pick roller 103. The timing Tb in the graphic representation of FIG. 12 corresponds to the state illustrated in FIG. 11B. In the printer 101 according to the second embodiment, a sheet feeding method of feeding the sheet S2 located underneath the sheet S1 while being partially overlapped with the sheet S1 is adopted. For this reason, according to the second embodiment, the driving of the pick roller 103 is maintained to be on even at the timing when the rear end of the sheet S1 passes through the position Pp corresponding to the nip portion of the pick roller 103. When the rear end of the sheet S1 passes through the pick roller 103, the pick roller 103 contacts with the sheet S2 and feeds the sheet S2. At the timing Tb of the graphic representation of FIG. 12, the driving of the pick roller 103 remains on, and the separation roller 105 is driven and rotated by the conveyed sheet S1.

Figure 11C:
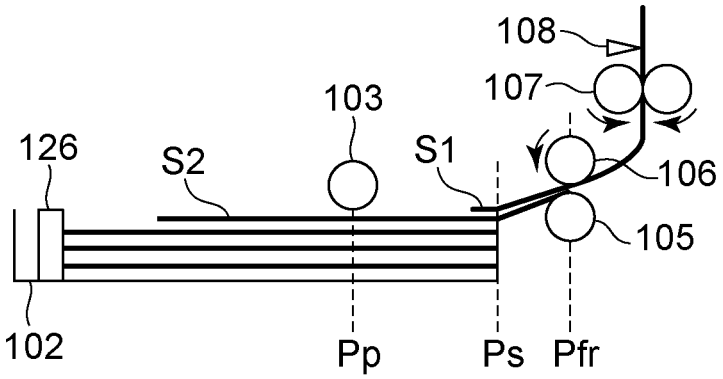

FIG. 11C illustrates a cross section of the cassette 102 at a timing when the leading end of the sheet S2 fed by the pick roller 103 reaches the position Pfr of the separation nip portion of the feed roller 106 and the separation roller 105. The timing Tc in the graphic representation of FIG. 12 corresponds to the state illustrated in FIG. 11C. In a case where the single sheet S is conveyed, the separation roller 105 rotates in the clockwise direction and feeds the single sheet S as described above. However, in a case where the two or more sheets S are overlapped with one another and conveyed, the separation roller 105 stops the rotation or rotates in the anticlockwise direction to separate the two or more sheets S into the single sheet S each. That is, the rotation state of the separation roller 105 changes. At the timing Tc in the graphic representation of FIG. 12, since the leading end of the sheet S2 reaches the position Pfr corresponding to the separation nip portion, the rotation of the separation roller 105 stops. When the leading end of the sheet S2 reaches the position Pfr corresponding to the separation nip portion, to avoid paper jam when the sheet S2 is pushed into the separation nip portion, the driving of the pick roller 103 is switched from on to off. The driving of the feed roller 106 is also turned off at this time but is driven and rotated by the sheet S1.

Figure 11D:
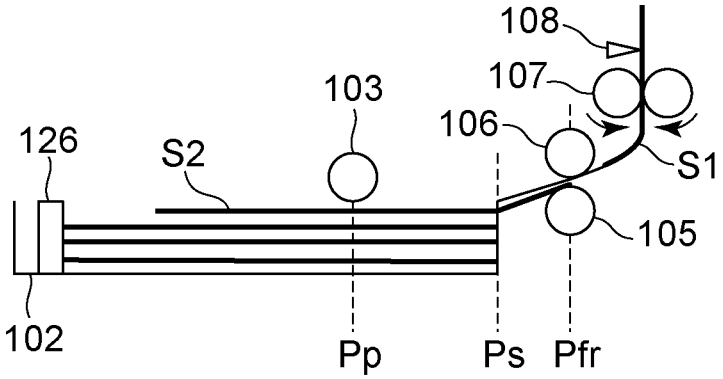
Figure 12:
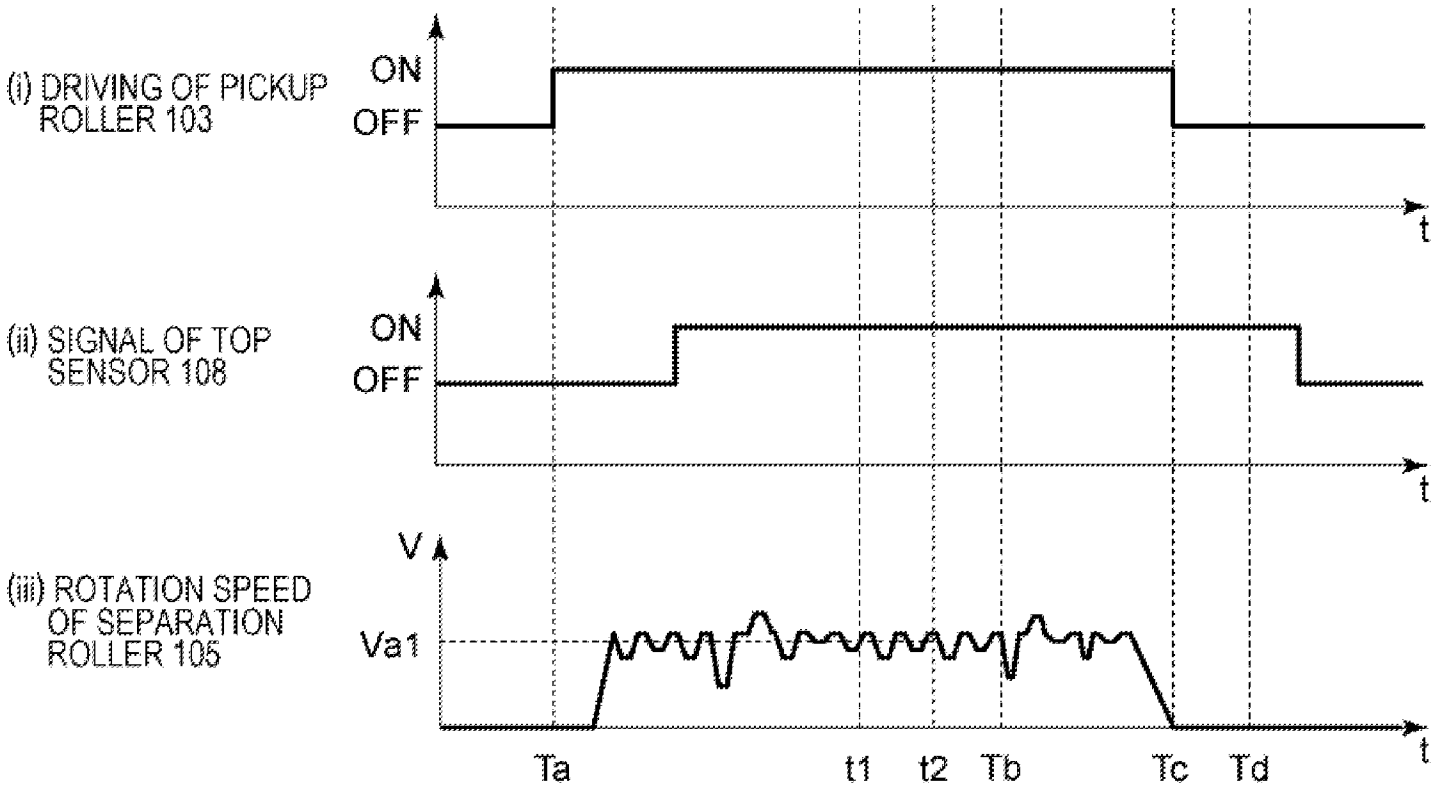
FIG. 12 is a timing chart in a case where the sheet feeding control is executed according to the second embodiment.

FIG. 11D illustrates a cross section of the cassette 102 at a timing, after the rear end of the sheet S1 passes through the position Pfr of the separation nip portion of the feed roller 106 and the separation roller 105. The timing Td in the graphic representation of FIG. 12 corresponds to the state illustrated in FIG. 11D. Since the sheet S1 passes through the position Pfr corresponding to the separation nip portion, the rotation of the feed roller 106 stops.

As described above, the driving of the pick roller 103 is turned off in the printer 101 according to the second embodiment under a condition where the leading end of the sheet S2 reaches the position Pfr corresponding to the separation nip portion and the rotation of the separation roller 105 has stopped or rotated in the opposite direction. Since the sheet S2 is fed in advance while being overlapped with the sheet S1, it is possible to align the leading end position of the sheet S2 to the position Pfr corresponding to the separation nip portion. The above-described sheet feeding control will be hereinafter referred to as preceding sheet feeding. When the preceding sheet feeding is performed, it is possible to shorten a distance between the rear end of the sheet S1 and the leading end of the sheet S2 (hereinafter, referred to as a sheet interval) in a case where the sheet feeding operation is continuously performed. That is, it is possible to refine the number of printed sheets per unit time and productivity of the printer 101.

In the sheet feeding control described with reference to FIGS. 4A to 4D, since there is a possibility that the leading end position of the sheet S may vary between the position Ps and the position Pfr due to the influence from the friction of the mutual sheets or the like, the sheet interval is not to be shorter than this interval. However, when the preceding sheet feeding using the encoder 203 is executed, the sheet interval can be shorter than this interval, which leads to the refinement in productivity.

New Product Detection of the Separation/Feed Rollers

Next, the new product detection for the separation roller 105 and the feed roller 106 according to the second embodiment will be described. In the printer 101 according to the second embodiment, in a case where the preceding sheet feeding is not performed such as a case of the first sheet feeding after the cassette 102 is attached to the main body of the printer 101 or printing of the single sheet (the number of job sheets is 1), it is possible to determine whether or not the roller unit is the new product by a method similar to that of the first embodiment. On the other hand, in a case where the preceding sheet feeding is performed, the roller new product determination method different from that of the first embodiment is used. Herein, a case where the preceding sheet feeding has been performed refers to a state in which the preceding sheet feeding operation is executed when a leading sheet (denoted as S1) ahead of a target sheet (denoted as S2) is fed, and the leading end of the target sheet S2 is aligned with the position Pfr corresponding to the separation nip portion.

According to the first embodiment, it is determined as to whether or not the rotation speed of the separation roller 105 becomes lower than or equal to 0 before the timing Td in FIG. 5 of the rear end of the sheet S1 so that the erroneous detection as the new product is not performed in a case where two or more sheets are taken out together to the separation nip portion due to the friction of the mutual sheets. According to the second embodiment, as described above, since the sheet S2 is previously fed while being overlapped with the sheet S1, it becomes possible to align the leading end position of the sheet S2 to the position Pfr corresponding to the separation nip portion. For this reason, in a case where the preceding sheet feeding is performed, the rotation speed of the separation roller 105 becomes lower than or equal to 0 irrespective of whether or not the multiple feed occurs due to the friction of the mutual sheets at the timing Td in the graphic representation of FIG. 11A. In addition, in a case where the preceding sheet feeding is performed, since the leading end of the sheet S2 is at the position Pfr corresponding to the separation nip portion, as the sheet feeding time according to the second embodiment is shorter than that of the first embodiment. In a case where the preceding sheet feeding is not performed, the sheet feeding time according to the second embodiment is the same as that of the first embodiment.

Figure 13A:
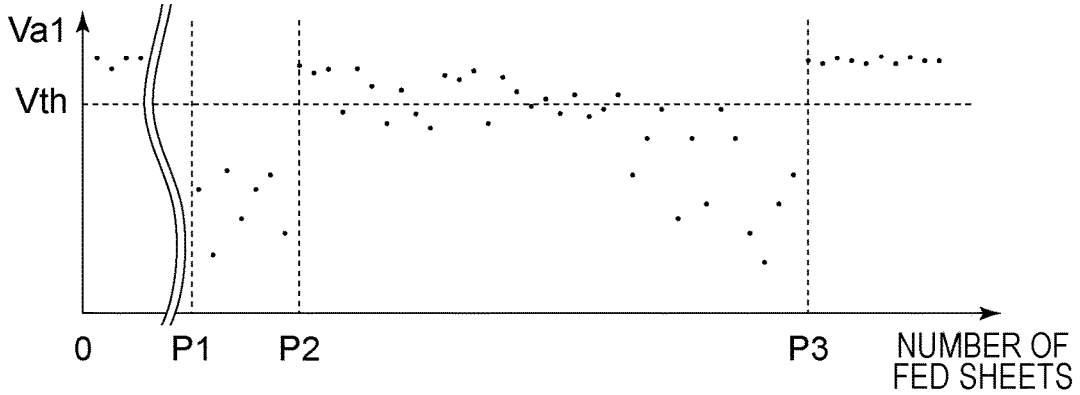
FIGS. 13A to 13C are graphical representations of the relationship among the number of fed sheets, the separation roller rotation speed, and the sheet feeding time according to the second embodiment.

FIG. 13A is a graphic representation illustrating transition of the average value Va1 of the rotation speed of the separation roller 105 according to the second embodiment. The horizontal axis in FIG. 13A indicates the number of fed sheets S. The average value Va1 of the rotation speed of the separation roller 105 and the number of fed sheets are similar to those of the first embodiment.

Figure 13B:
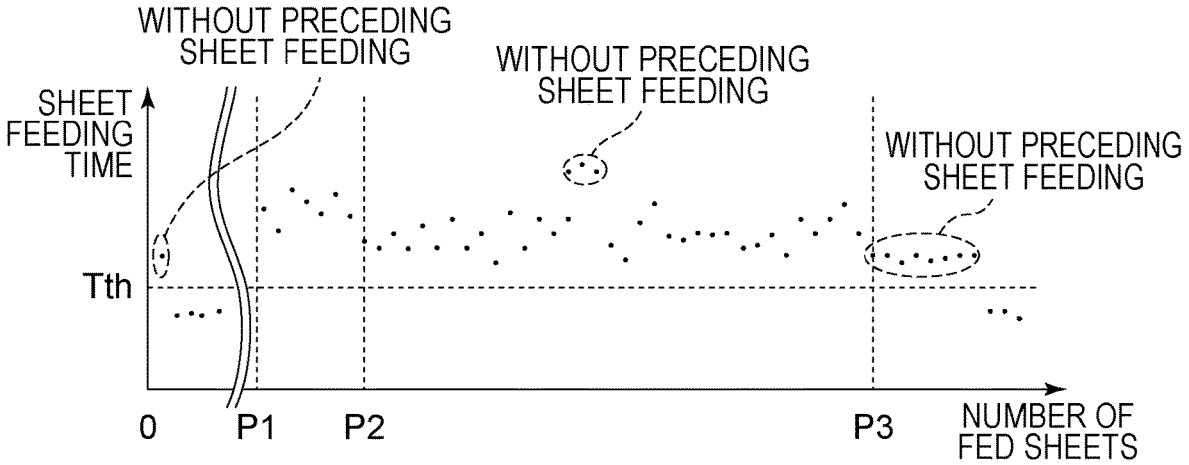

FIG. 13B is a graphic representation illustrating transition of the sheet feeding time according to the second embodiment. The horizontal axis in FIG. 13B indicates the number of fed sheets S. In a case where the preceding sheet feeding is not performed, as compared with the case where the preceding sheet feeding is performed, the sheet feeding time becomes longer by the amount corresponding to the distance from the leading end position Ps of the sheet S to Pfr. At the number P3 of fed sheets, it is assumed that the separation roller 105 and the feed roller 106 are replaced with the new product rollers. At the number P3 of fed sheets and thereafter, a period in a case where the printing for the single sheet is repeatedly performed, that is, a period in which the preceding sheet feeding is not performed the sheet feeding time becomes longer than that of a case where the preceding sheet feeding is performed. For this reason, there is a possibility that the sheet feeding time in a case where the preceding sheet feeding is not performed in the roller new product status and the sheet feeding time in a case where the preceding sheet feeding is performed in the roller end-of-life status may be an equivalent time. Therefore, it is difficult to determine whether or not the roller unit is the new product depending on whether or not the sheet feeding time is shorter than the threshold time Tth as in the first embodiment.

Figure 13C:
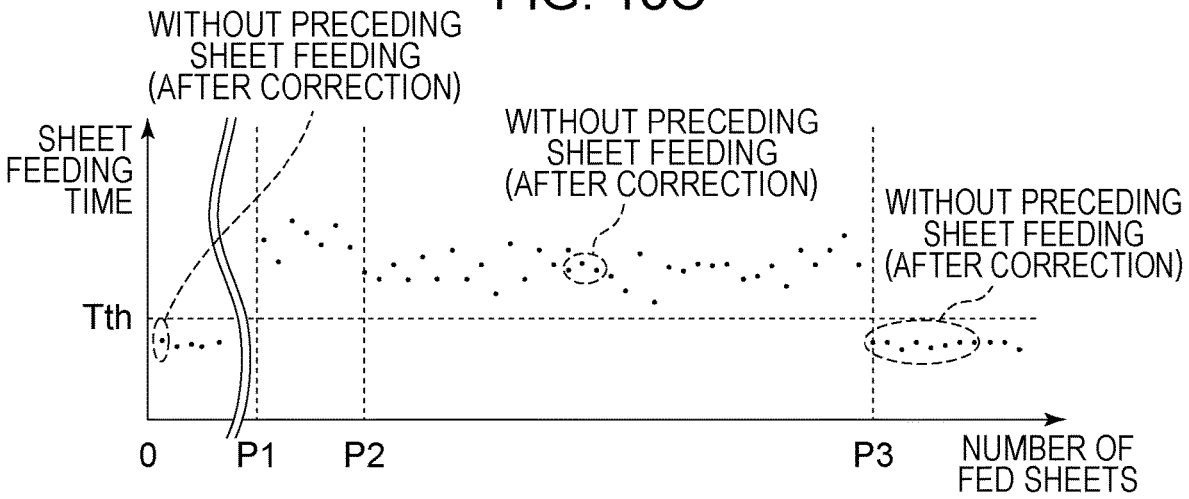

In view of the above, the printer 101 according to the second embodiment corrects a difference of the sheet feeding time in a case where the preceding sheet feeding is performed and detects the roller new product. FIG. 13C is a graphic representation indicating transition of the sheet feeding time after the correction. In a case where the preceding sheet feeding is not performed, a time Tsfr equivalent to the distance from the leading end position Ps of the sheet S to Pfr is subtracted from the sheet feeding time. With this configuration, the influence due to the difference in the sheet feeding time depending on the presence or absence of the preceding sheet feeding is reduced or eliminated, and it is possible to determine the new products of the separation roller 105 and the feed roller 106 similarly as in the first embodiment.

Roller Unit New Product Determination Processing

The new product determination method for the separation roller 105 and the feed roller 106 according to the second embodiment will be described with reference to flow charts of FIG. 14 and FIG. 15. Control based on the flow charts of FIG. 14 and FIG. 15 is executed by the engine control unit 201 installed in the image forming apparatus control unit 200 based on the program stored in the storage unit 209 such as the ROM.

Figure 14:
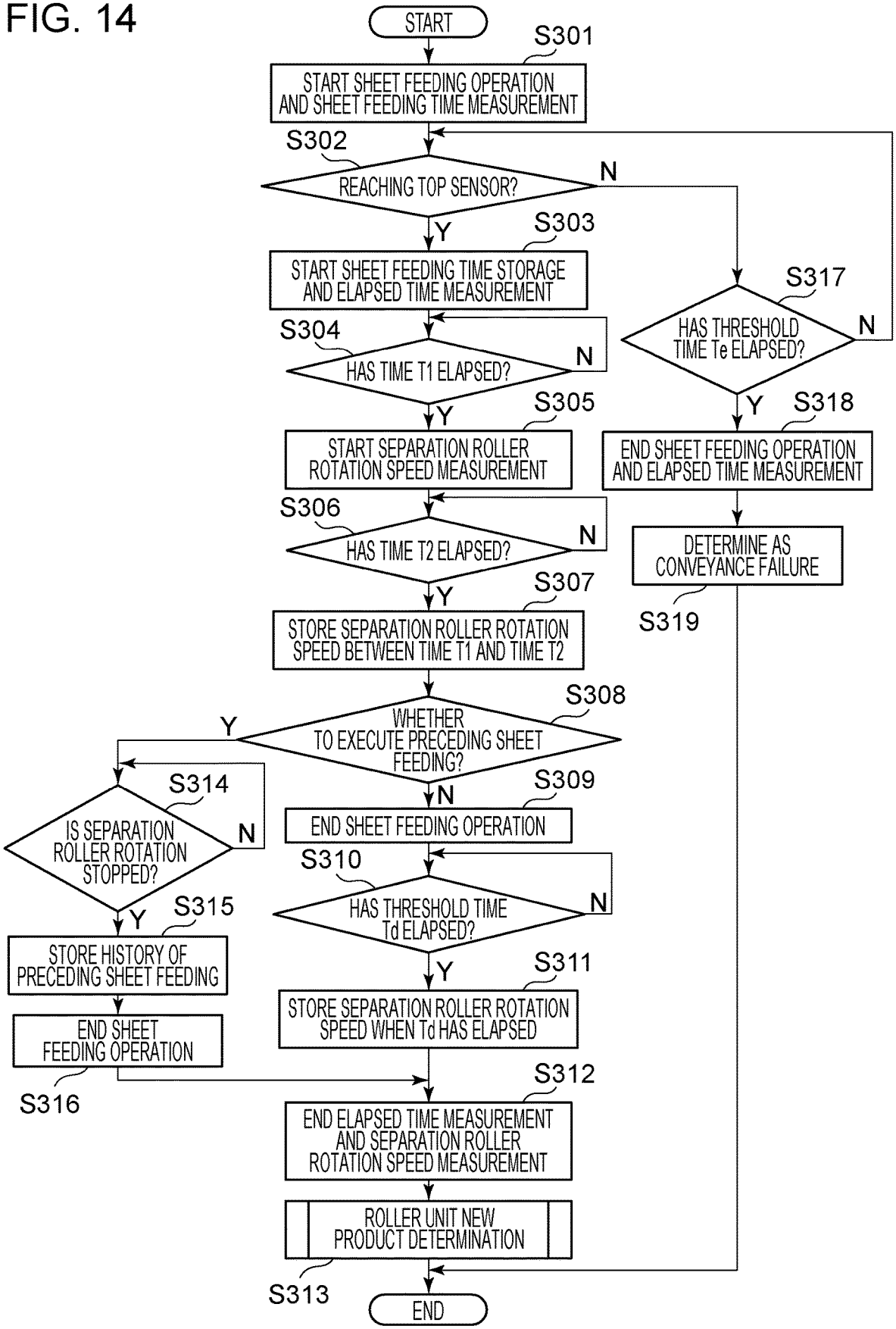
FIG. 14 is a flow chart illustrating the new product determination processing according to the second embodiment.
Figure 15:
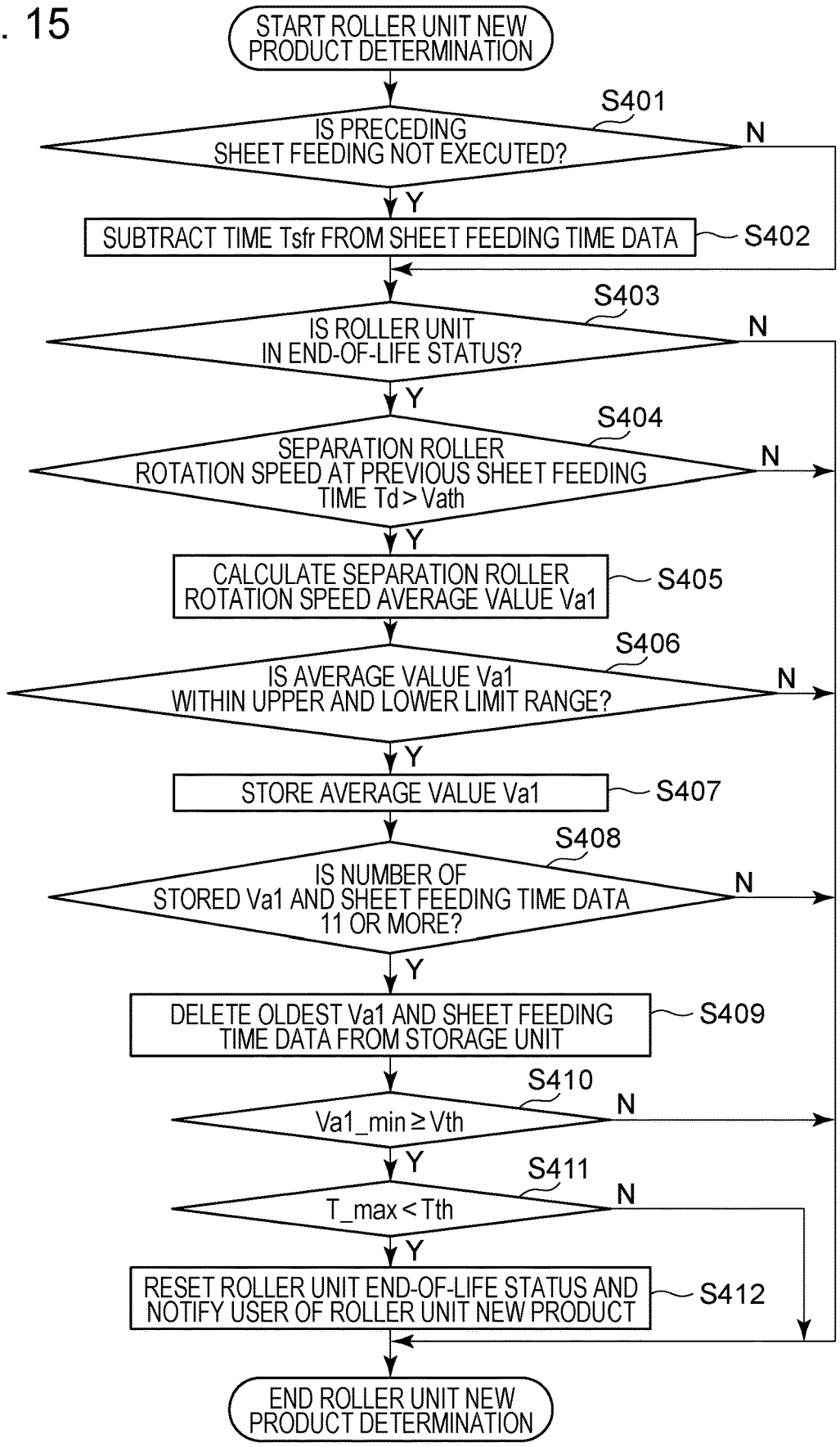
FIG. 15 is a flow chart illustrating the new product determination processing of the separation/feed rollers according to the second embodiment.

In FIG. 14, the processing in S301 to S307 is similar to the processing in S101 to S107 of FIG. 9, and the descriptions will be omitted. In S308, the engine control unit 201 determines whether or not the preceding sheet feeding is performed. Whether or not the preceding sheet feeding is performed is determined based on the number of printing job sheets. In a case where the number of printing job sheets is one or the sheet is the last sheet of the multiple printing jobs, the engine control unit 201 determines that the preceding sheet feeding is not performed. A reason therefor is, for example, the sheet S is not to be deformed after the end of the printing in a side oriented configuration (configuration in which an attachment/detachment direction of the cassette 102 is orthogonal to the feeding direction of the sheet S) as a result of the release of the cassette 102 in state in which the sheet S is stuck at the separation nip portion. In S308, in a case where the engine control unit 201 determines that the preceding sheet feeding is not performed, the processing proceeds to S309. In S308, in a case where the engine control unit 201 determines that the preceding sheet feeding is performed, the processing proceeds to S314. The processing in S309 to S313 is similar to the processing in S108 to S112 of FIG. 9, and the descriptions will be omitted.

In S314, the engine control unit 201 determines whether or not the rotation of the separation roller 105 is stopped based on the rotation speed of the separation roller 105 which is currently measured by the measurement unit 206. In S314, in a case where the engine control unit 201 determines that the rotation of the separation roller 105 not stopped and the rotation continues, the processing returns of S314, and the measurement of the rotation speed of the separation roller 105 still continues. In S314, in a case where the engine control unit 201 determines that the rotation of the separation roller 105 stops, the processing proceeds to S315. It should be noted that the engine control unit 201 does not necessarily need to stand by until the rotation of the separation roller 105 stops in S314, and the processing may proceed to S315 at a timing when the rotation speed of the separation roller 105 is lower than the threshold speed.

In S315, the engine control unit 201 stores the history indicating that the preceding sheet feeding has been performed in the storage unit 209 and stops the driving of the pick roller 103 by the driving control unit 210 in S316 to end the sheet feeding operation, and the processing proceeds to S312. The processing in S317 to S319 is similar to the processing in S113 to S115 of FIGS. 8A and 8B, and the descriptions will be omitted.

Next, a detail of the new product determination processing for the roller unit in S313 will be described with reference to FIG. 15. In S401, the engine control unit 201 reads out history information of the preceding sheet feeding which is stored in the storage unit 209. The engine control unit 201 determines whether or not the preceding sheet feeding is performed based on the read history information of the preceding sheet feeding. In S401, in a case where the engine control unit 201 determines that the preceding sheet feeding is not performed, the processing proceeds to S402. In S401, in a case where the engine control unit 201 determines that the preceding sheet feeding is performed, the processing proceeds to S403.

In S402, the engine control unit 201 subtracts the time Tsfr (correction time) equivalent to the distance from the leading end position Ps of the sheet S to Pfr from the sheet feeding time data stored in the storage unit 209 and stores the data after the calculation in the storage unit 209 as the sheet feeding time at that time. The processing in S403 to S412 is similar to the processing in S203 to S212 of FIG. 9, and the descriptions will be omitted.

As described above, according to the second embodiment, the following benefit is attained in addition to the benefit of the first embodiment. According to the second embodiment, in the image forming apparatus provided with the sheet feeding control function for performing the preceding sheet feeding to align the leading end position of the subsequent sheet S2 to the separation nip portion, the influence based on the difference in the sheet feeding time due to the presence or absence of the preceding sheet feeding is reduced or eliminated, and it is possible to determine the new product of the roller unit.

Herein, the time Tsfr may be changed depending on the number of fed sheets of the roller or the end-of-life status by taking into account the conveyance performance degradation caused by the roller friction. In addition, the time Tsfr may be changed depending on the paper type or the environment by taking into account the influence affecting the sheet feeding time due to the paper type or the environment.

Third Embodiment

A third embodiment will be described. The descriptions of the main parts are similar to the first embodiment, and only parts different from the first embodiment will be described herein.

New Product Detection of the Separation/Feed Rollers

Figure 16A:
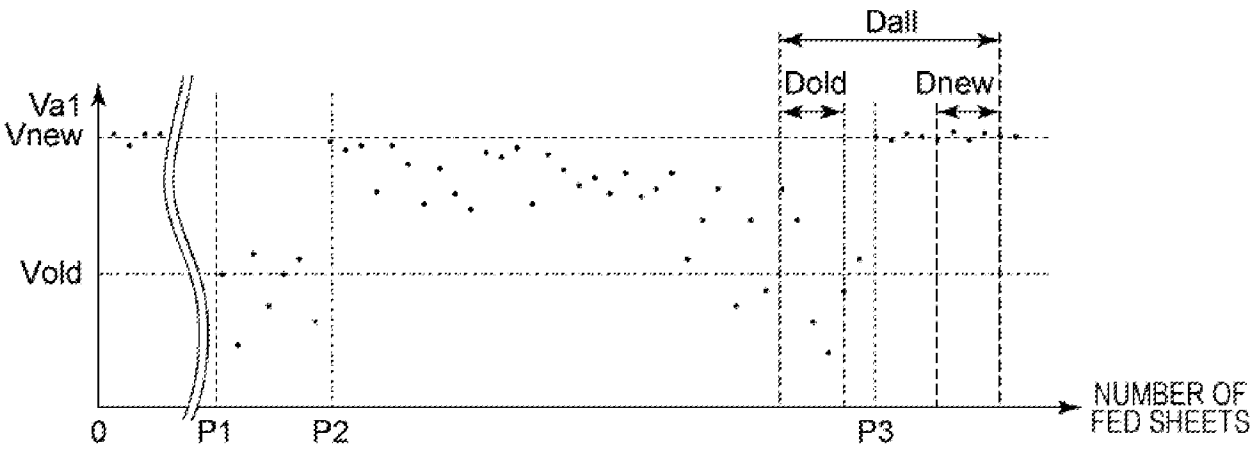
FIGS. 16A and 16B are graphical representations of the relationship among the number of fed sheets, the separation roller rotation speed, and the sheet feeding time according to third embodiment.
Figure 16B:
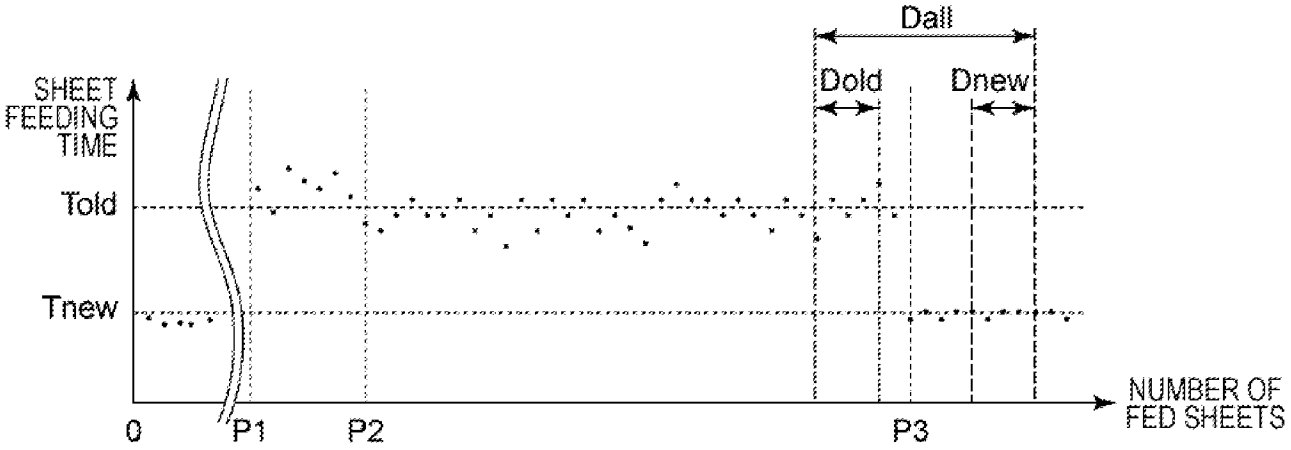

The new product detection for the separation roller 105 and the feed roller 106 according to the third embodiment will be described. FIGS. 16A and 16B are graphic representations indicating transition of the average value Va1 of the rotation speed of the separation roller 105 and the sheet feeding time similarly as in FIGS. 8A and 8B. The average value Va1 of the rotation speed of the separation roller 105 and the sheet feeding time data are similar to those of FIGS. 8A and 8B.

According to the third embodiment, a predetermined number Dall of data pieces of the average value Va1 of the rotation speed of the separation roller 105 and the sheet feeding time are stored. When the printer 101 performs the sheet feeding and the average value Va1 of the rotation speed of the separation roller 105 and the sheet feeding time data are newly measured, the oldest data is deleted, and the latest data is stored. Among the stored data, an average value of the average value Va1 of the rotation speed data of the separation roller 105 for a predetermined number Dold (for example, five pieces) of oldest data is set as Vold, and an average value of the sheet feeding time data for a predetermined number fold (for example, five pieces) of oldest data is set as Told. In addition, among the stored data, an average value of the average value Va1 of the rotation speed data of the separation roller 105 for a predetermined number Dnew (for example, five pieces) of latest data is set as Vnew, and an average value of the sheet feeding time data for the predetermined number Dnew (for example, five pieces) of latest data is set as Tnew. As a result, in a case where the separation roller 105 and the feed roller 106 is replaced with the new product roller at the number P3 of fed sheets, the difference between Vnew and Vold and the difference between Told and Tnew are increased.

Therefore, it is possible to determine the new products of the separation roller 105 and the feed roller 106 similarly as in the first embodiment depending on whether or not the difference between Vnew and Vold and the difference between Told and Tnew is higher than or equal to the predetermined threshold. As compared with the method of previously setting the predetermined threshold as in the first embodiment, it is possible to suppress the influence from the variation of the rotation speed of the separation roller or the sheet feeding time caused by the individual difference of the printers and rollers onto the detection accuracy.

Roller Unit New Product Determination Processing

Figure 17:
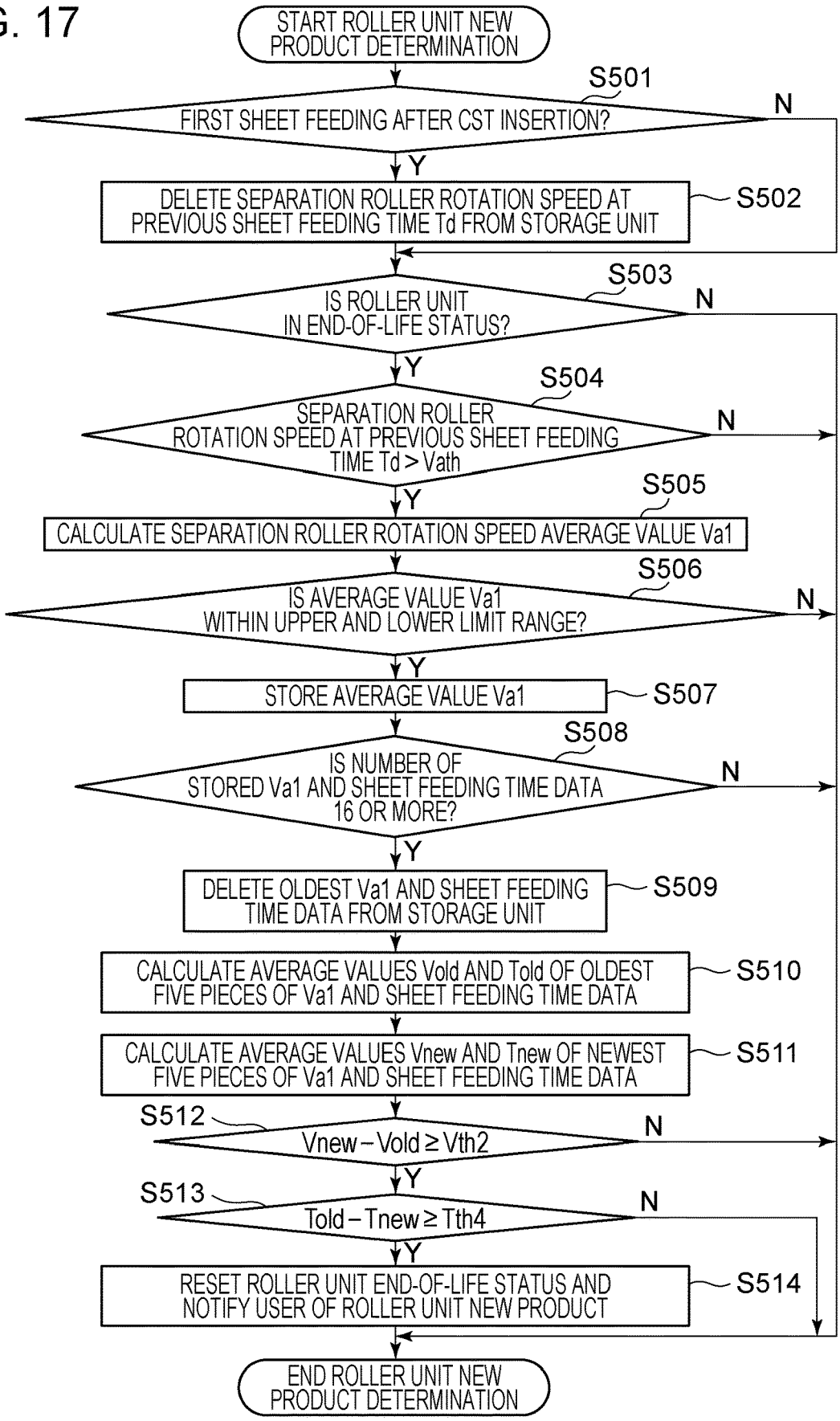
FIG. 17 is a flow chart illustrating the new product determination processing of the separation/feed rollers according to the third embodiment.

The new product determination method for the separation roller 105 and the feed roller 106 according to the third embodiment will be described with reference to a flow chart of FIG. 17. Control based on the flow chart of FIG. 17 is executed by the engine control unit 201 installed in the image forming apparatus control unit 200 based on the program stored in the storage unit 209 such as the ROM. It should be noted that the processing related to the sheet feeding control is similar to FIG. 9, and the descriptions will be omitted.

In FIG. 17, the processing in S501 to S507 is similar to the processing in S201 to S207 of FIG. 10, and the descriptions will be omitted. In S508, it is determined as to whether or not the number of data pieces of the average value Va1 of the rotation speed of the separation roller 105 stored in the storage unit 209 is a predetermined number, for example, 16. Herein, the number of data pieces stored in the storage unit 209 is not limited to 16. In S508, in a case where the engine control unit 201 determines that the number of data pieces stored in the storage unit 209 is lower than 16, the roller new product determination is ended. In S508, in a case where the engine control unit 201 determines that the number of data pieces stored in the storage unit 209 is higher than or equal to 16, the processing proceeds to S509.

In S509, the engine control unit 201 deletes the single oldest data piece among the 16 data pieces of the average value Va1 of the rotation speed of the separation roller 105 which are stored in the storage unit 209. The engine control unit 201 further deletes the single oldest data piece among the 16 data pieces of sheet feeding time data which are measured at the same sheet feeding time as the data pieces of the average value Va1 of the rotation speed of the separation roller 105 which are stored in the storage unit 209.

In S510, the engine control unit 201 calculates the average value Vold of the predetermined number of oldest data pieces, for example, five pieces of data from the data of the average value Va1 of the rotation speed of the separation roller 105 stored in the storage unit 209 to be stored in the storage unit 209. Furthermore, in S510, the engine control unit 201 calculates an average value Told of the predetermined number of oldest data pieces, for example, five pieces of data from the sheet feeding time data stored in the storage unit 209 to be stored in the storage unit 209. Herein, the number of data pieces stored in the storage unit 209 is not limited to five.

In S511, the engine control unit 201 calculates an average value Vnew of the predetermined number of latest data pieces, for example, five pieces of data from the data of the average value Va1 of the rotation speed of the separation roller 105 stored in the storage unit 209 to be stored in the storage unit 209. Furthermore, in S511, the engine control unit 201 calculates an average value Tnew of the predetermined number of latest data pieces, for example, five pieces of data from the sheet feeding time data stored in the storage unit 209 to be stored in the storage unit. 209. Herein, the number of data pieces stored in the storage unit 209 is not limited to five.

In S512, the engine control unit 201 determines whether or not a difference between the average value Vnew and the average value Vold stored in the storage unit 209 is higher than or equal to a threshold Vth2. In a case where the difference between the average value Vnew and the average value Vold is higher than or equal to the threshold Vth2, the processing proceeds to S513. In a case where the difference between the average value Vnew and the average value Vold is lower than the threshold Vth2, the roller new product determination is ended.

In S513, the engine control unit 201 determines whether or not a difference between the average value Told and the average value Tnew stored in the storage unit 209 is higher than or equal to a threshold Vth4. In a case where the difference between the average value Told and the average value Tnew is higher than or equal to the threshold Vth4, the processing proceeds to S514. In a case where the difference between the average value Told and the average value Tnew is lower than the threshold Vth4, the roller new product determination is ended.

In S514, the engine control unit 201 determines that the roller unit is the new product and changes the status to the new product status. The engine control unit 201 also uses the panel 211 and notifies the user that the roller unit is the new product by the panel output unit 208 and ends the roller unit new product determination.

With the above-described configuration, according to the third embodiment, the following benefit is attained in addition to the benefit of the first embodiment. As compared with the method of previously setting the predetermined threshold as in the first embodiment, when the data pieces in the two or more groups are selected to be compared with one another according to the third embodiment, it is possible to suppress the influence from the variation of the rotation speed of the separation roller or the sheet feeding time caused by the individual difference of the printers and rollers onto the detection accuracy.

According to the first to third embodiments described above, the descriptions have been provided while the configuration including the pickup roller 103, the separation roller 105, and the feed roller 106 is used as the feeding mechanism of the sheet S, but the configuration is not limited to this. For example, a configuration may be adopted in which the feed roller 106 contacts with the sheet S loaded in the cassette 102 and also forms the separation nip portion with the separation roller 105. In the case of this configuration, since the feed roller 106 also plays the role of the pickup roller 103, the pickup roller 103 does not need to be provided. It should be noted that the sheet feeding time is measured by using the driving start timing of the feed roller 106 as a starting point instead of the driving start timing of the pickup roller 103 in the case of this configuration.

In addition, according to the first to third embodiments described above, the separation roller 105 and the feed roller 106 have been described as the examples, but the configuration is not limited to this. For example, not only the rollers but also a rotating body such as a belt may also be set as the target. A configuration may be adopted in which the separation roller 105 and the feed roller 106 are integrally constructed and can be replaced together, or a configuration may also be adopted in which the separation roller 105 and the feed roller 106 can individually be replaced.

Moreover, according to the first to third embodiments described above, the example of the laser beam printer has been described, but the configuration may be applied to a feeding optional apparatus that can be detachably attached to the laser beam printer main body. In this case, the control unit illustrated in FIG. 2 or FIG. 3 may be included in the feeding optional apparatus, or a configuration may also be adopted in which the above-described control is realized when the control unit included in the laser beam printer main body communicates with the control unit included in the feeding optional apparatus.

Furthermore, according to the first to third embodiments described above, the example of the laser beam printer has been described, but the image forming apparatus to which the embodiment of the present disclosure is applied is not limited to this, and a printer such as an inkjet printer or a copier based on another printing system may also be used.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-141120 filed Jul. 20, 2017, which is hereby incorporated by reference herein in its entirety.

What is claimed is:

1. A feeding apparatus comprising:

a rotary member unit including a feeding rotary member configured to feed a recording material and including a separating rotary member which forms a nip portion with the feeding rotary member, wherein, in a case where a single recording material is fed to the nip portion, the separating rotary member is configured to be rotated in a predetermined direction by the single recording material and, in a case where a plurality of recording material is overlapped with one another and fed to the nip portion, rotation of the separating rotary member is configured to be stopped or rotated in a direction opposite to the predetermined direction to separate the overlapped plurality of recording material from one another at the nip portion;

an output unit configured to output a state signal in accordance with a rotation state of the separating rotary member; and a control unit configured to obtain a rotation speed of the separating rotary member in a predetermined period included in a time from when a leading end of a currently fed recording material reaches the nip portion until a rear end of the currently fed recording material passes through the nip portion every time a feeding operation of the recording material by the rotary member unit is performed, and determine that the rotary member unit is replaced with a new product in a case where an obtained average rotation speed of the separating rotary member is higher than or equal to a first threshold for a predetermined number of times in succession.

2. The feeding apparatus according to claim 1, wherein the control unit obtains, as a plurality of average rotation speeds, the average rotation speed of the separating rotary member in the predetermined period each time a feeding operation of the recording material by the rotary member unit is performed, obtains, from among the plurality of average rotation speeds, a maximum value of average rotation speeds and a minimum value of average rotation speeds, sets a difference between the maximum value and the minimum value as a variation of the obtained rotation speed of the separating rotary member, and determines that the rotary member unit is replaced with the new product in a case where the variation is lower than a second threshold a predetermined number of times in succession.

3. The feeding apparatus according to claim 1, wherein the control unit obtains an average rotation speed of the separating rotary member in the predetermined period each time a feeding operation of the recording material by the rotary member unit is performed, selects two or more groups from among a plurality of the average rotation speeds, and determines whether the rotary member unit is replaced with the new product based on a result of a comparison of the selected two or more groups.

4. The feeding apparatus according to claim 1, wherein the control unit obtains, as a plurality of average rotation speeds, an average rotation speed of the separating rotary member in the predetermined period each time a feeding operation of the recording material by the rotary member unit is performed, obtains, from among a plurality of average speeds, a maximum value of the average rotation speeds and a minimum value of the average rotation speeds, sets a difference between the maximum value and the minimum value as a variation of the obtained rotation speed of the separating rotary member, selects two or more groups from among a plurality of the variations, and determines whether the rotary member unit is replaced with the new product based on a result of a comparison of the selected two or more groups.

5. A feeding apparatus comprising:

a rotary member unit including a feeding rotary member configured to feed a recording material and including a separating rotary member which forms a nip portion with the feeding rotary member, wherein, in a case where a single recording material is fed to the nip portion, the separating rotary member is configured to be rotated in a predetermined direction by the single recording material and, in a case where a plurality of recording material is overlapped with one another and fed to the nip portion, rotation of the separating rotary member is configured to be stopped or rotated in a direction opposite to the predetermined direction to separate the overlapped plurality of recording material from one another at the nip portion;

a pickup rotating body arranged on an upstream side with respect to the feeding rotary member in a sheet feeding direction of the recording material and configured to feed the recording material loaded in a tray to the nip portion;

an output unit configured to output a state signal in accordance with a rotation state of the separating rotary member; and a control unit configured to obtain a rotation speed of the separating rotary member from the state signal output from the output unit and, based on the obtained rotation speed of the separating rotary member, to determine whether the rotary member unit is replaced with a new product, wherein the control unit instructs to stop a feeding operation by the pickup rotating body before a rear end of the currently fed recording material passes through the pickup rotating body.

6. The feeding apparatus according to claim 5, wherein, in a case where the obtained rotation speed of the separating rotary member becomes lower than or equal to a threshold before the rear end of the currently fed recording material passes through the nip portion, the control unit does not perform determining whether the rotary member unit is replaced with the new product.

7. A feeding apparatus comprising:

a rotary member unit including a feeding rotary member configured to feed a recording material and including a separating rotary member which forms a nip portion with the feeding rotary member, wherein, in a case where a single recording material is fed to the nip portion, the separating rotary member is configured to be rotated in a predetermined direction by the single recording material and, in a case where a plurality of recording material is overlapped with one another and fed to the nip portion, rotation of the separating rotary member is configured to be stopped or rotated in a direction opposite to the predetermined direction to separate the overlapped plurality of recording material from one another at the nip portion;

a pickup rotating body arranged on an upstream side with respect to the feeding rotary member in a sheet feeding direction of the recording material and configured to feed the recording material loaded in a tray to the nip portion;

an output unit configured to output a state signal in accordance with a rotation state of the separating rotary member;

a detection unit arranged on a downstream side with respect to the feeding rotary member in the sheet feeding direction and configured to detect the recording material fed by the feeding rotary member; and a control unit configured to obtain a rotation speed of the separating rotary member from the state signal output from the output unit and, based on the obtained rotation speed of the separating rotary member, to determine whether the rotary member unit is replaced with a new product, wherein the control unit determines whether the rotary member unit is replaced with the new product based on the rotation speed of the separating rotary member in a predetermined period and a feeding time from when the feeding of the recording material by the pickup rotating body is started until the detection unit detects a leading end of the recording material.

8. The feeding apparatus according to claim 7, wherein the control unit obtains an average rotation speed of the separating rotary member in the predetermined period each time a feeding operation of the recording material by the rotary member unit is performed, and determines that the rotary member unit is replaced with the new product in a case where the average rotation speed is higher than or equal to a first threshold a predetermined number of times in succession and also the feeding time is shorter than a second threshold a predetermined number of times in succession.

9. The feeding apparatus according to claim 7, wherein the control unit obtains, as a plurality of average rotation speeds, an average rotation speed of the separating rotary member in the predetermined period each time a feeding operation of the recording material by the rotary member unit is performed, obtains, from among the plurality of average speeds, a maximum value of the average rotation speeds and a minimum value of the average rotation speeds, sets a difference between the maximum value and the minimum value as a variation of the obtained rotation speed of the separating rotary member, and determines that the rotary member unit is replaced with the new product in a case where the variation is lower than a first threshold a predetermined number of times in succession and also the feeding time is shorter than a second threshold a predetermined number of times in succession.

10. The feeding apparatus according to claim 7, wherein the control unit switches and executes first feeding control (i) for instructing (A) to stop a feeding operation by the pickup rotating body before a rear end of a currently fed recording material passes before the pickup rotating body and second feeding control for instructing to start a feeding operation of a first recording material by the pickup rotating body, and (B) to continue, in a case where the obtained rotation speed of the separating rotary member represented by the state signal from the output unit is faster than a threshold rotation speed, the feeding operation by the pickup rotating body to perform a feeding operation of a second recording material following the feeding operation of the first recording material, and (ii) for instructing, in a case where the obtained rotation speed of the separating rotary member represented by the state signal from the output unit becomes slower than the threshold rotation speed, to stop the feeding operation of the second recording material by the pickup rotating body before the rotation of the separating rotary member stops.

11. The feeding apparatus according to claim 10, wherein the control unit subtracts, from the feeding time, a correction time measured in a case where the first feeding control is executed, and corrects a duration of the feeding time to be shorter.

12. The feeding apparatus according to claim 7, wherein the control unit obtains a feeding time each time a feeding operation of the recording material by the rotary member unit is performed, selects two or more groups from among a plurality of the feeding times, and determines whether the rotary member unit is replaced with the new product based on a result of a comparison of the selected two or more groups.

* * * * *